US006815884B2

(12) United States Patent
Yamada et al.

(10) Patent No.: US 6,815,884 B2
(45) Date of Patent: Nov. 9, 2004

(54) ELECTRON SOURCE FORMING SUBSTRATE, AND ELECTRON SOURCE AND IMAGE DISPLAY APPARATUS USING THE SAME

(75) Inventors: Shuji Yamada, Kanagawa (JP); Kazuya Ishiwata, Kanagawa (JP); Tadayasu Meguro, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 09/847,420

(22) Filed: May 3, 2001

(65) Prior Publication Data

US 2002/0070677 A1 Jun. 13, 2002

(30) Foreign Application Priority Data

May 8, 2000 (JP) ..... 2000-134824

(51) Int. Cl.[7] ..... H01J 1/62; H01J 63/04

(52) U.S. Cl. ..... 313/495; 313/496; 313/497; 313/310; 313/309

(58) Field of Search ..... 313/309–311, 495–497

(56) References Cited

U.S. PATENT DOCUMENTS

| | | | | |
|---|---|---|---|---|
| 4,954,744 A | | 9/1990 | Suzuki et al. | 313/336 |
| 5,598,052 A | * | 1/1997 | Khan et al. | 313/310 |
| 5,831,387 A | * | 11/1998 | Kaneko et al. | 313/495 |
| 5,872,541 A | * | 2/1999 | Yoshioka et al. | 345/74.1 |
| 5,965,898 A | * | 10/1999 | Jones et al. | 257/10 |
| 6,091,188 A | * | 7/2000 | Tomihari et al. | 313/336 |
| 6,208,071 B1 | | 3/2001 | Nishimura et al. | |
| 6,459,207 B1 | * | 10/2002 | Nomura et al. | 315/169.3 |
| 6,492,769 B1 | * | 12/2002 | Oda et al. | 313/495 |
| 6,522,054 B2 | * | 2/2003 | Shibata | 313/310 |

FOREIGN PATENT DOCUMENTS

| | | |
|---|---|---|
| EP | 0850892 A1 | 7/1998 |
| JP | 01-279538 | 11/1989 |
| JP | 01-279540 | 11/1989 |
| JP | 01-298624 | 12/1989 |
| JP | 10-241550 | 9/1998 |

OTHER PUBLICATIONS

W.P. Dyke, Advances in Electronics and Electron Physics, 8, 89 (1956); Field Emission.

C.A. Spindt, Journal of Applied Physics, 47, 5248 (1976); Physical properties of thin–film field emission cathodes with molybdenum cones.

M.I. Elinson, Radio Engineering Electron Physics, 10, 1290 (1965); The Emission of Hot Electrons and the Field Emission of Electrons from Tin Oxide.

G. Dittmer, Thin Solid Films, 9, 317 (1972); Electrical Conduction and Electron Emission of Discontinuous Thin Films.

M. Hartwell, IEEE Transactions Electron Devices Conference, 519 (1975); Strong Electron Emission from Patterned Tin–Indium Oxide Thin Films.

H. Araki, Journal of the Vacuum Society of Japan, vol. 26, No. 1, p. 22 (1983); Electroforming and Electron Emission of Carbon Thin Films.

* cited by examiner

*Primary Examiner*—Vip Patel
*Assistant Examiner*—Anthony Perry
(74) *Attorney, Agent, or Firm*—Fitzpatrick, Cella, Harper & Scinto

(57) ABSTRACT

An electron source forming substrate wherein an insulating material film is disposed on the surface of the substrate at which surface an electron-emitting device is arranged. The insulating material film contains a plurality of metallic oxide particles having an average particle size within the range of 6 nm to 60 nm as expressed in a median value, and suppresses undesirable diffusion of Na from the substrate, thereby makes stable an electron-emitting characteristics, without an adverse effect due to the Na diffusion, even elapsing longer time.

23 Claims, 14 Drawing Sheets

ELECTRON SOURCE FORMING SUBSTRATE, AND ELECTRON SOURCE AND IMAGE DISPLAY APPARATUS USING THE SAME

BACKGROUND OF THE INVENTION

1. Field of the Invention

The present invention relates to an electron source forming substrate used in forming an electron source and to the electron source and an image forming apparatus using the substrate.

2. Related Background Art

Heretofore in the past, there have been known electron-emitting devices, which are broadly classified into two types using thermionic electron-emitting devices and cold cathode electron-emitting devices. For the cold cathode electron-emitting devices, there are available field emission type (hereinafter referred to as "FE type"),metal/insulating layer/metal type (hereinafter referred to as "MIM type"), surface conduction type electron-emitting device and the like.

As an example of the FE type, there are known those devices as disclosed in W. P. Dyke & W. W. Dolan, "Field emission", Advance in Electron Physics, 8.89 (1956) or C. A. Spindt. "Physical properties of Thin-Film Field Emission Cathodes with Molybdenium Cones", J. Appl. Phys., 47,5248 (1976) and the like.

As an example of the surface conduction type electron-emitting device type, there are known those as disclosed in M. I. Elinson, Recio Eng. Electron Phys., 10,1290 (1965) and the like.

The surface conduction type electron-emitting device utilizes a phenomenon where electron emission occurs by letting current flow in parallel with a film surface on a thin film of a small area formed on a substrate. For the surface conduction type electron-emitting device, there are reported those which use $SnO_2$ thin film by the above described Elinson and the like, Au thin film "G. Dittmer: "Thin solid Films", 9, 317 (1972)", $In_2O_3/SnO_2$ thin film "M. Hartwell and C. G. Fonstad: "IEEE Trans. ED Conf." 519 (1975)", carbon thin film "Hisashi Araki et. al: SHINNKUU Vol.26, No. 1, 22 pages (1983)" and the like.

To utilize the above described electron-emitting device by holding an electron source arranged and constructed on a substrate inside an envelope which is kept vacuum inside, it is necessary to connect the electron source to the envelope and other members. This connection is usually performed by heating and fusion by using frit glass. The heating temperature at this time is typically approximately 400° C. to 500° C. and the time thereof is typically approximately ten minutes to one hour, which differs depending on the size of the envelope.

For the material of the envelope, in view of simplicity and reliability of the connection by frit glass and relatively inexpensive cost, soda lime glass is preferably used. Also, because a high strain point glass where a strain point is raised by replacing a part of Na by K is easy for frit connection, it can be preferably used as well. Also, with regard to the material of the substrate of the above described electron source, in view of reliability of the connection to the envelope, similarly the soda lime glass or the above described high strain point glass is preferably used.

The above described soda lime glass contains alkali element metal as its component and particularly contains the large volume of Na as $Na_2O$. Na element is easy to diffuse by heat and, therefore, when exposed to high temperatures during a processing, Na is sometimes diffused into each type of members formed on the soda lime glass, particularly into the member constituting the electron-emitting device, thereby deteriorating its characteristics.

It was reveled that the above described influence by Na sometimes occurs, but to a lessened degree, by that much if Na content is small when the above described high strain point glass is used as the substrate of the electron source.

As means for reducing the above described influence of Na, for example, there are disclosed in Japanese Patent Application Laid-Open No. 10-241550, EP-A-850892 an electron source forming substrate where the concentration of Na of the surface area of the side where the electron-emitting device of the substrate containing Na is at least arranged is smaller than that of other area and also an electron source forming substrate having a phosphorus containing layer.

SUMMARY OF THE INVENTION

It is an object of the present invention to provide at a low cost an electron source forming substrate where time changes in the electron-emitting characteristics of the electron-emitting device is reduced, and to provide the electron source as well as an image display apparatus using the substrate.

The present invention provides the electron source forming substrate where the electron emitting device are arranged, comprising a substrate and an insulating material film which is disposed on the surface of the substrate, at which surface the above described electron-emitting device of the above described substrate is arranged, and contains a plurality of metallic oxide particles having an average particle size within the range of 6 nm to 60 nm as expressed in a median value.

Also, the present invention provides the electron source forming substrate where the electron emitting device are arranged, comprising a substrate and an $SiO_2$ film which is disposed on the surface where the above described electron-emitting device of the above described substrate is arranged, and which contains a plurality of metallic oxide particles having an average particle size within the range of 6 nm to 60 nm as expressed in the median value.

Also, the present invention provides the electron source, comprising the substrate and the electron-emitting device arranged on the above described substrate, wherein the above described substrate is any of the above described electron source forming substrates.

Also, the present invention provides the image display apparatus comprising an envelope and an image display member for displaying images by irradiation of the electron from an electron-emitting device and the above described electron-emitting device, wherein the substrate where the above described electron-emitting devices are arranged is any of the above described electron source forming substrates.

The electron source forming substrate of the present invention is an electron source forming substrate wherein the electron-emitting device is arranged, comprising the substrate and the insulating material film which is disposed on the surface where the above described electron-emitting device of the above described substrate is arranged, and which contains a plurality of metallic oxide particles having an average particle size within the range of 6 nm to 60 nm as expressed in the median value.

In the above described electron source forming substrate of the present invention, as still further preferable embodiments, the above described insulating material film further contains phosphorus, the above described insulating material film further contains phosphorus having 1 weight portion to 10 weight portions, the thickness of the above described insulating material film is within the range of 200 nm to 600 nm, the thickness of the above described insulating material film is within the range of 300 nm to 400 nm, on the above described insulating material film, a film comprising the insulating material is laminated, the thickness of the film comprising the above described insulating material is within the range of 20 nm to 150 nm, and the thickness of the film comprising the above described insulating material is within the range of 40 nm to 100 nm.

Also, the electron source forming substrate of the present invention is an electron source forming substrate where the electron-emitting device is arranged, comprising the substrate and the $SiO_2$ film which is disposed on the surface where the above described electron-emitting device of the above described substrate is arranged, and contains a plurality of metallic oxide particles having an average particle size within the range of 6 nm to 60 nm as expressed in the medial value.

In the above described electron source forming substrate, as still further preferable embodiment:

the above described $SiO_2$ further contains phosphorus, the above described $SiO_2$ further contains phosphorus having one weight portion to 10 weight portions, the thickness of the above described $SiO_2$ film is within the range of 200 nm to 600 nm, the thickness of the above described $SiO_2$ film is within the range of 300 nm to 400 nm, on the above described $SiO_2$ film, a film comprising $SiO_2$ is further laminated, the thickness of the film comprising the above described $SiO_2$ is within the range of 20 nm to 150 nm, and the thickness of the film comprising the above described $SiO_2$ is within the range of 40 nm to 100 nm.

In the above described electron source forming substrate of the present invention, as still further preferable embodiments, the average particle size as expressed in the above described median value is within the range of 15 nm to 30 nm, the above described metallic oxide particles are electronically conductive oxide particles, the above described metallic oxide particles are the particles of the metal chosen from Fe, Ni, Cu, Pd, Ir, In, Sn, Sb and Re, the above described metallic oxide particles are the particles of $SiO_2$, and the above described substrate is a substrate containing sodium.

Also, the electron source of the present invention is an electron source comprising the substrate and the electron-emitting device disposed on the above described substrate, wherein the above described substrate is the above described electron source forming substrate of the present invention.

In the above described electron source of the present invention, as still further preferable embodiments, the above described electron-emitting device is an electron-emitting device comprising an conductive film containing an electron-emitting portion, a plurality of the above described electron-emitting devices are matrix-wired in a plurality of row-directional wirings and in a plurality of column-directional wirings, the above described electron-emitting device is an electron-emitting device comprising an conductive film containing an electron-emitting portion between a pair of electrodes, and a plurality of the above described electron-emitting devices are matrix-wired by a plurality of row-directional wirings and a plurality of column-directional wirings and the above described one pair of electrodes are constituted by the material comprising platinum as the principal component and the above described wirings are constituted by the material comprising silver as the principal component.

Also, the image display apparatus of the present invention is an image display apparatus comprising the enveloper and the image display member which is arranged inside the above described enveloper and displays images by irradiation of the electron from the electron-emitting device and the above described electron-emitting device, wherein the substrate where the above described electron-emitting device is arranged is the above described electron source forming substrate of the present invention.

In the above described image display apparatus of the present invention, as still further preferable embodiments, the above described electron-emitting device is an electron-emitting device comprising the conductive film containing the electron-emitting portion, a plurality of the above described electron-emitting devices are matrix-wired by a plurality of row-directional wirings and a plurality of column-directional wirings, the above described electron-emitting device is an electron-emitting device comprising the conductive film containing the electro-emitting portion between a pair of electrodes, and a plurality of the above described electron-emitting devices are matrix-wired by a plurality of row-directional wirings and a plurality of column-directional wirings and the above described one pair of electrodes are constituted by the material comprising platinum as the principal component and the above described wirings are constituted by the material comprising silver as the principal component.

According to the study by the present inventors, it was revealed that, depending on the insulating material film containing metallic oxide particles formed as an Na block layer on the substrate, the type and the shape of the film containing, for example, $SiO_2$ formed on this insulating material film, dope materials and the film thickness, characteristics change largely and only when an optimum configuration is given, the effect thereof is sufficiently demonstrated.

It was also revealed that not only by the configuration of the film, but also by the electrode, the wiring, the material of the electron-emitting device film and the like formed on the substrate, a process and a heat history, the optimum configuration can change.

In the electron source forming substrate of the present invention, by having the insulating material film containing a plurality of metallic oxide particles having an average size of particle within the range of 6 nm to 60 nm as expressed in the median value on the surface where the electron-emitting device of the substrate is arranged, specifically, the $SiO_2$ film containing $SnO_2$ particles, Na in a glass substrate containing mainly $SiO_2$ of 50 to 75 weight % and Na of 2 to 17 weight % can be effectively blocked. For this reason, the electron-emitting device using the electron source forming substrate of the present invention can reduce elapsed time changes of the electron-emitting characteristics and obtain the steady electron-emitting characteristics.

Also, particularly by using the electronically conductive oxide particles as the above described metallic oxide particles, much steadier electron-emitting characteristics can be obtained. In the present invention, the term electronically conductive oxide particle is used for ion conductivity and the disposing of the electronically conductive material has the following advantages.

That is, by disposing a layer containing the electronically conductive material on the substrate, the substrate surface shows electrical conductivity and unsteadiness during the drive by charge-up can be controlled. To provide this electrical conductivity, when the iron electrically conductive material is used, a voltage relative to the drive is applied and ion moves while the voltage is applied for a long time and as a result the ion is segregated, thereby bringing about a situation where electron source characteristics become unsteady. This is considered to occur because the time required for the movement of the ion is, for example, so much that the movement of the iron is not fully restored between pulses, that is, within a quiescent period in the case where the voltage relative to the drive is applied in the pulse form. Such a segregation of the ion has a bad influence on the electron source characteristics. Accordingly, particularly when the substrate has a layer containing the electronically conductive material and the conduction is mainly due to the electron conduction, the segregation of the ion hardly occurs so that the influence on the above described electron source characteristics can be avoided.

Also, for the above described metallic oxide particles, it is particularly preferable to use the particles of $SnO_2$. This $SnO_2$ is in the market at relatively low cost and the conduction is mainly due to the electron conduction and can be easily used as solution for coating and film depositing.

Also, by doping phosphorus into the insulating material film (for example, $SiO_2$ film), the resistance value of the film can be easily controlled. Also, it was revealed that an adequate doping of phosphorus enhances the block effect of sodium. Although this mechanism is not yet clarified, it is considered that sodium in the substrate glass forms some compounds with phosphorus and is fixed there so that the diffusion of sodium into the substrate surface is restrained.

Also, on the above described insulating material film (for example, $SiO_2$ film) which is a first layer, a film (for example, $SiO_2$ film) comprising the above described insulating material which is a second layer is further formed so that sodium block effect can be much more improved than the block effect expected from each film alone.

Also, it was revealed that when, for example, a burning process of an approximately 500° C. is repeated by using platinum for the electrode of the electron-emitting device and silver for wiring and, the diffusion of sodium into the surface is large. Even in such a case, by using the sodium block layer of the present invention, the diffusion of Na can be effectively blocked.

BRIEF DESCRIPTION OF THE DRAWINGS

FIG. 2A is a top plane view and FIG. 2B is a sectional view;

FIG. 3A is a top plane view and FIG. 3B is a sectional view;

FIG. 4A is a top plane view and FIG. 4B is a sectional view;

DETAILED DESCRIPTION OF THE PREFERRED EMBODIMENTS

Hereinafter, the preferred embodiments of the present invention will be described with reference to the drawings.

Figure 1:
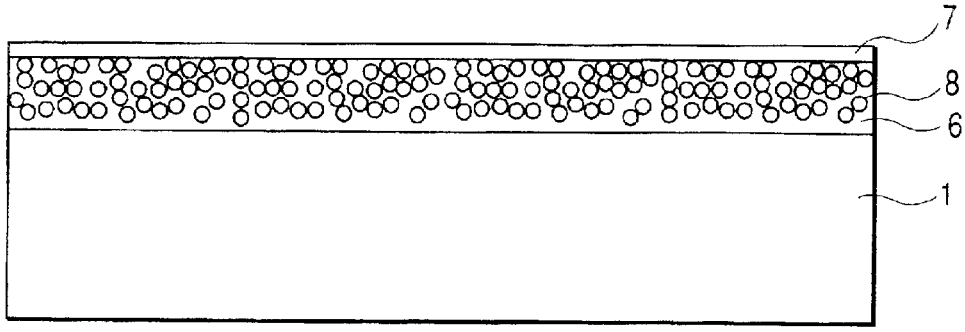
FIG. 1 is a typical sectional view showing one example of an electron source forming substrate of the present invention.

FIG. 1 is a sectional view showing one aspect of the embodiment of an electron source forming substrate of the present invention. In FIG. 1, reference numeral 1 denotes a substrate such as, for example, soda lime glass containing Na or a high strain point glass where a part of Na is replaced by K and a strain point is raised and the like, reference numeral 6 denotes a first layer containing metallic oxide particles, reference numeral 7 a second layer formed on the first layer and reference numeral 8 denotes metallic oxide particles inside the first layer 6.

Here, the electron source forming substrate of the present invention as shown in FIG. 1 has an electron-emitting device formed on the second layer 7.

The insulating material film which is a first layer 6 is a film preferably comprising $SiO_2$ as the principal component and the thickness thereof is equal to or more than 200 nm, more preferably equal to or more than 300 nm from the view point of the effect on controlling the above described Na diffusion. Although there is no upper limit imposed to the characteristic film thickness, when the film becomes too thick, there is caused a problem relating to adhesion with the substrate. Therefore, the thickness is preferably equal to or less than 1 $\mu$m, more preferably equal to or less than 600 nm, or still more preferably equal to or less than 400 nm.

The particle size of the metallic oxide particles 8 is preferably 6 nm to 60 nm in average as expressed in the median value and still more preferably 15 nm to 30 nm. When this average particle size is too small, a film deposition requires a lot of time and cost and the preparation of the substrate becomes difficult. On the other hand, when this average size is too big, flatness on the first layer is inhibited and adherence to the electrode, the wiring and the like becomes deteriorated and an adverse influence is exerted at the time when the electron-emitting device is prepared.

For the metallic oxide particles 8, for example, the oxide particles of metal chosen from Fe, Ni, Cu, Pd, Ir, In, Sn, Sb and Re can be used and, in particular, the electronically conductive oxide particles chosen from $SnO_2$ and the like are preferably used.

Also, by doping phosphorus into the first layer, the value of resistance of the film can be easily controlled and suitable doping of phosphorus can enhance the block effect of sodium. To be concrete, it is preferable that the first layer contains phosphorus in 1 weight portion to 10 weight portions.

Also, the second layer 7 is a layer comprising the insulating material, preferably $SiO_2$ as the principal component. This layer is disposed for the purpose of improving the flatness of the substrate surface where the electron-emitting device is formed, preventing dropping out of the metallic oxide particles 8 inside the above described first layer 6 and preventing the Na diffusion. This second layer 7 is formed on the first layer 6 and covers concavity or convexity of the metallic oxide particles so as to improve the flatness thereof and make it easy to form the electron-emitting device. Also, because the first layer 6 alone is difficult to steadily adhere the metallic oxide particles on the substrate, the second layer 7 performs the adhesion and also plays a role of preventing dropping out of the metallic oxide particles.

The thickness of the second layer 7 is preferably equal to or more than 20 nm from the view point of improving the flatness and, from the view point of the effect on preventing the Na diffusion, preferably equal to or more than 40 nm and still more preferably equal to or more than 60 nm. Also, from the view point of preventing the occurrence of fissures and the peeling off of the film due to stress in the film, the thickness is further desired to be equal to or less than 1 $\mu$m, preferably equal to or less than 150 nm and still more preferably equal to or less than 100 nm.

Next, the preferred embodiments of the electron source using the above described electron source forming substrate will be described by using FIGS. 2A and 2B.

Figure 2A:
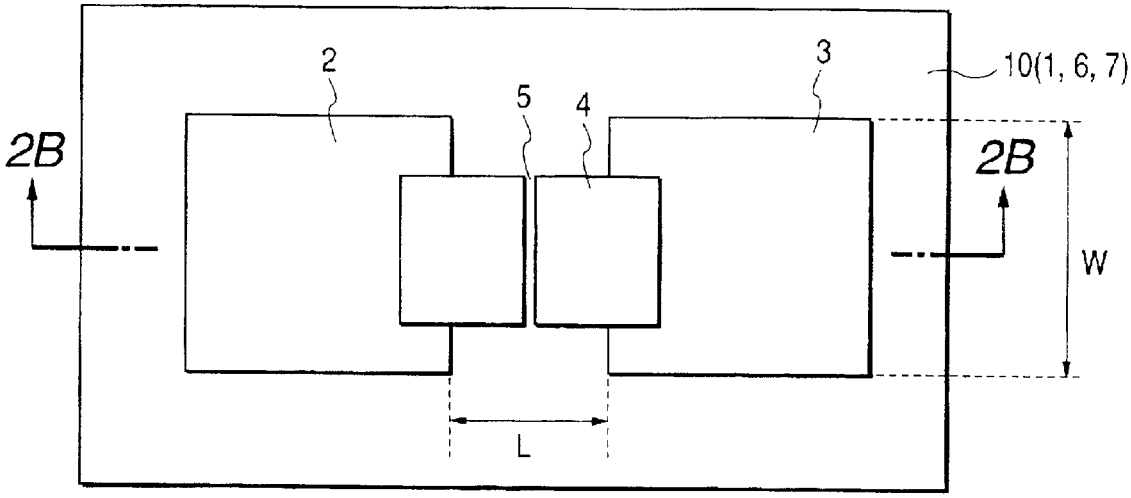
FIGS. 2A and 2B are schematic views showing one example of an electron source of the present invention.
Figure 2B:
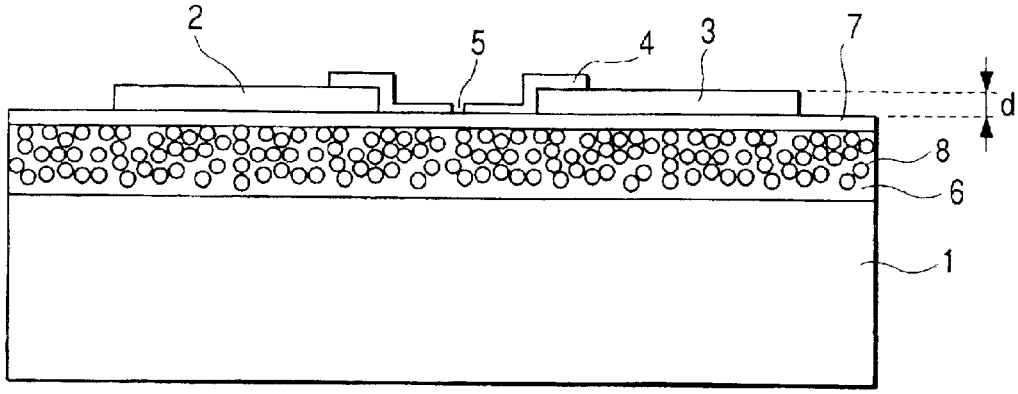

FIGS. 2A and 2B are schematic views showing one aspect of the embodiment of the electron source of the present invention. FIG. 2A is a plan view and FIG. 2B is a sectional view. The electron source of the present embodiment is an electron source constructed by using the electron source forming substrate as shown in the above described FIG. 1. In FIGS. 2A and 2B, reference numerals 1, 6 and 7 denote the above described substrate containing Na, first layer and second layer, respectively.

The electron source of the present embodiment has the electron-emitting device arranged on the second layer 7. Here, the electron-emitting device is an electron-emitting device, for example, comprising one pair of electrodes and conductive films arranged between said one pair of electrodes and provided with an electron-emitting portion. In the present embodiment, as shown in FIGS. 2A and 2B, the surface conduction electron-emitting device comprising one pair of conductive films 4 arranged in such a manner as to be set apart by a gap 5 and one pair of device electrodes 2, 3 electrically connected to one pair of conductive films 4, respectively. Note that the surface conduction electron-emitting device as shown in FIGS. 2A and 2B are preferably a device in the shape of having a carbon film on the conductive film 4.

Here, the surface conduction e;ectron-emitting device used in the electron source of the present embodiment will be described in detail.

First, for the material of the opposing device electrodes 2, 3, the usual material can be used. For example, metal or alloy such as Ni, Cr, Au, Mo, W, Pt, Ti, AI, Cu, Pd and the like, or printed conductor composed of metal or metallic oxide Pd, Ag, Au, $RuO_2$, Pd—Ag and glass and the like, or transparent conductive material such as $In_2O_3$—$SnO_2$ and the like, or semiconductor material and the like such as polysilicon and the like can be suitably chosen.

Also, for the material constituting the conductive film 4, metal such as Pd, Pt, Ru, Ag, Au, Ti, In, Cu, Cr, Fe, Zn, Sn, Ta and W, or oxide such as PdO, $SnO_2$, $In_2O_3$, PdO, $Sb_2O_3$ and the like can be suitably chosen.

The conductive film 4 is preferably a fine particle film composed of a plurality of fine particles having a particle size within the range of 1 nm to 20 nm in order to obtain excellent electron-emitting characteristics. Also, the thickness of the conductive film 4 is preferably within the range of 1 nm to 50 nm.

Also, the gap 5 is formed by forming fissures on the conductive film formed across the device electrodes 2, 3 by the forming processing to be described later.

Also, as described above, it is preferable that the carbon film is formed on the conductive film 4 from the view point of improving the electron-emitting characteristics and reducing the elapsed time changes of the electron-emitting characteristics.

Figure 3A:
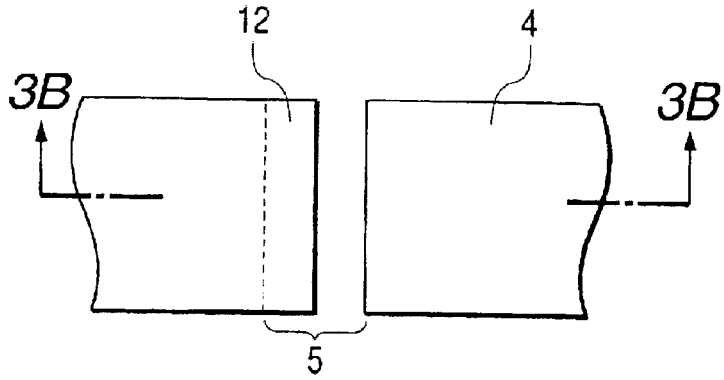
FIGS. 3A and 3B are typical partially enlarged views showing one example of a surface conduction electron-emitting device applied to the electron source of the present invention.
Figure 3B:
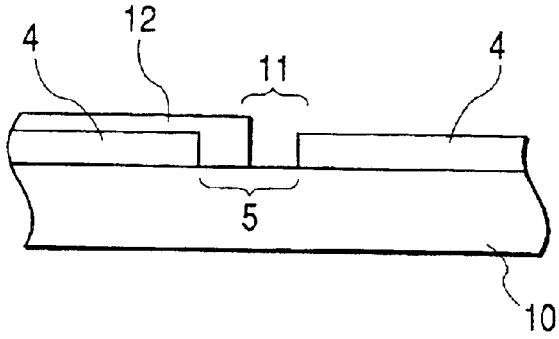

This carbon film is formed, for example, as shown in FIGS. 3A and 3B. Here, FIG. 3A is an enlarged typical plan view of the gap portion of the conductive film of the surface conduction electron-emitting device having the carbon film. FIG. 3B is a sectional view cut along 3B—3B line in FIG. 3A.

As shown in FIGS. 3A and 3B, the surface conduction electron-emitting device having the carbon film is connected to the conductive film 4 so that a gap 11 narrower than the gap 5 formed by the above described one pair of conductive films 4 is formed and has the carbon film 12 on the substrate 10 inside the gap 5 and on the conductive film 4.

Figure 4A:
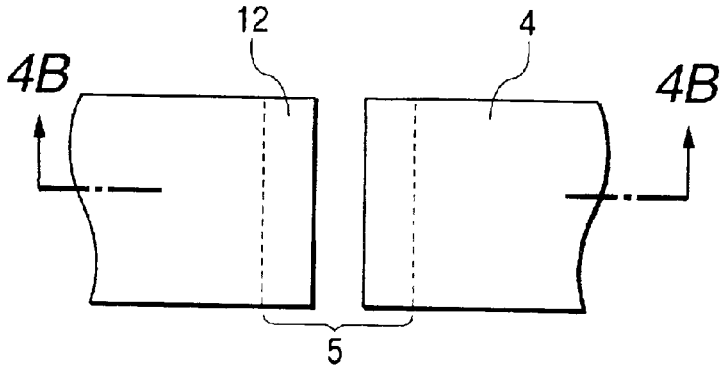
FIGS. 4A and 4B are typical partially enlarged views showing another example of the surface conduction electron-emitting device applied to the electron source of the present invention.
Figure 4B:
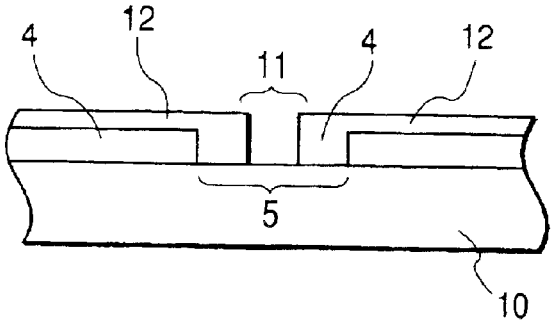

Also, as shown in FIGS. 4A and 4B, similar to the above, even when the carbon film 12 is provided on both ends facing the gap 5 of one pair of conductive films 4, the same effect can be achieved as described above.

Next, one example of the manufacturing method of the above described electron source as shown in FIGS. 2A and 2B will be described with reference to FIGS. 5A, 5B, 5C and 5D.

The Na containing substrate 1 such as soda lime glass, high strain point glass and the like is sufficiently cleaned by using cleanser, pure water, organic solvent and the like, and on such substrate 1, the first layer 6 is formed. Here, for the forming method of the first layer 6, it is preferable that a mechanical film deposition method such as a spin coat method, a flexo printing method, a slit coat and the like is used. What is meant by the mechanical film deposition method is a method wherein coating is performed by using a compound containing film deposition element by using equipment such as a spin coater, a slit coater, flexo printing machine and the like and, thereafter, by going through a drying step, the baking of the organic compound is performed for the film deposition. These methods have advantages of making the film having a relatively uniform thickness.

Subsequently, on this first layer 6, the second layer 7 is formed. Here, for the forming method of the second layer 7, it is preferable to use the mechanical film deposition method same as the film deposition method of the first layer 6 because the film can be formed continuously from the formation of the above described first layer 6. As an example, coating solution containing the electronically conductive oxide is applied by the spin coat method and dried and then coating solution comprising $SiO_2$ as the principal component is subsequently applied and thereafter collectively baked so that the first layer is covered by the second layer.

Figure 5A:
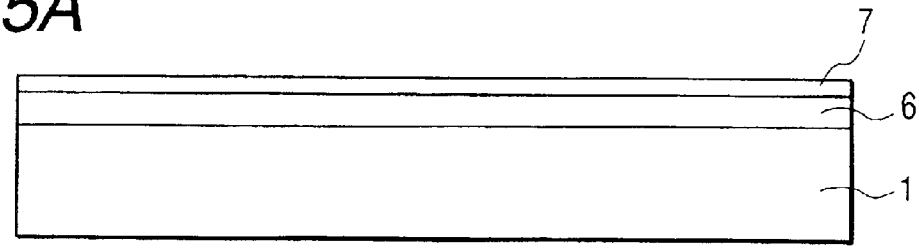
FIGS. 5A, 5B, 5C and 5D are schematic views for explaining the manufacturing procedure of the electron source according to the present invention.

In such a manner as described above, the electron source forming substrate is formed, wherein the first layer 6 is laminated on the second layer 7 in this order (FIG. 5A).

Next, the electron-emitting device, above all, the surface conduction electron-emitting device is formed on the above described electron source forming substrate.

Figure 5B:
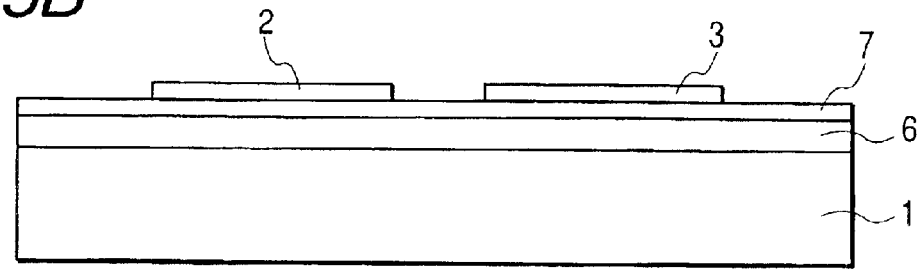

First, by a vacuum evaporation method, a sputtering method, an offset printing method and the like, the device electrode material is deposited. After that, by using, for example, photolithography technology, the device electrodes 2, 3 are formed on the second layer 7 (FIG. 5B).

Figure 5C:
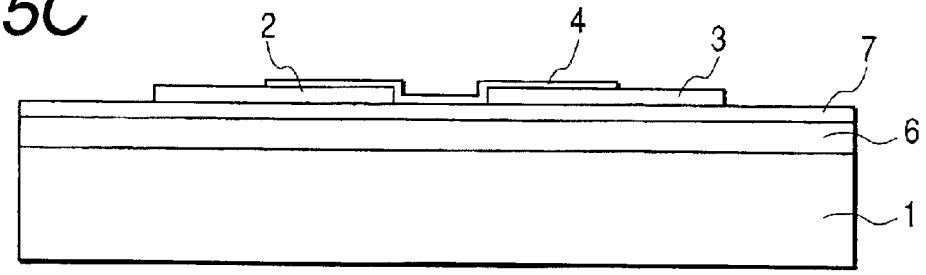

Next, on the second layer 7 where the device electrodes 2, 3 are disposed, organometallic solution is applied so as to form an organometallic thin film. For the organometallic solution, the solution of an organometallic compound where the chief element is the metal of the material of the above described conductive film 4 can be used. The organometallic thin film is processed with heating and baking and treated with patterning by lift-off, etching and the like so as to form the conductive film 4 (FIG. 5C). Here, while the description was made by citing the application method of the organometallic solution, the forming method of the conductive film 4 is not limited to this, and the vacuum evaporation method, the sputtering method, but a chemical vapor deposition method, a dispersed application method, a dipping method, a spinner method and the like can be also used.

Figure 5D:
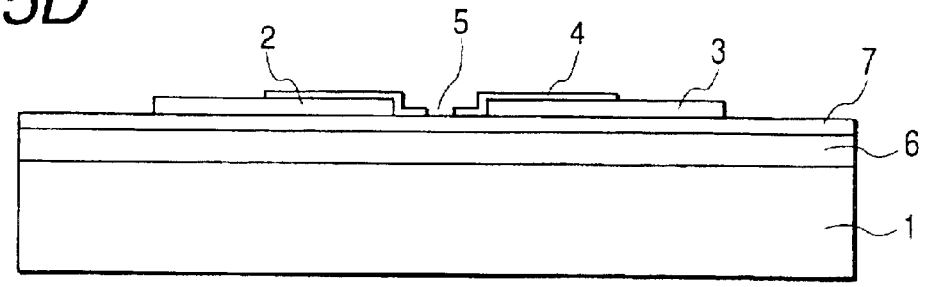

Subsequently, a forming step is performed. As one example of this forming step, a method by an energization operation will be described. When an energization is performed by using a power source (not shown) between the device electrodes 2, 3, the gap 5 is formed on the conductive film 4 (FIG. 5D). An example of the voltage wave of the energization forming is shown in FIGS. 6A and 6B.

The voltage wave is preferably a pulse wave form. To realize this form, there are available the method as shown in FIG. 6A where the pulse which takes a pulse crest value as a constant voltage is continuously applied and the method as shown in FIG. 6B where the voltage pulse is applied while the pulse crest value is increased.

Figure 6A:
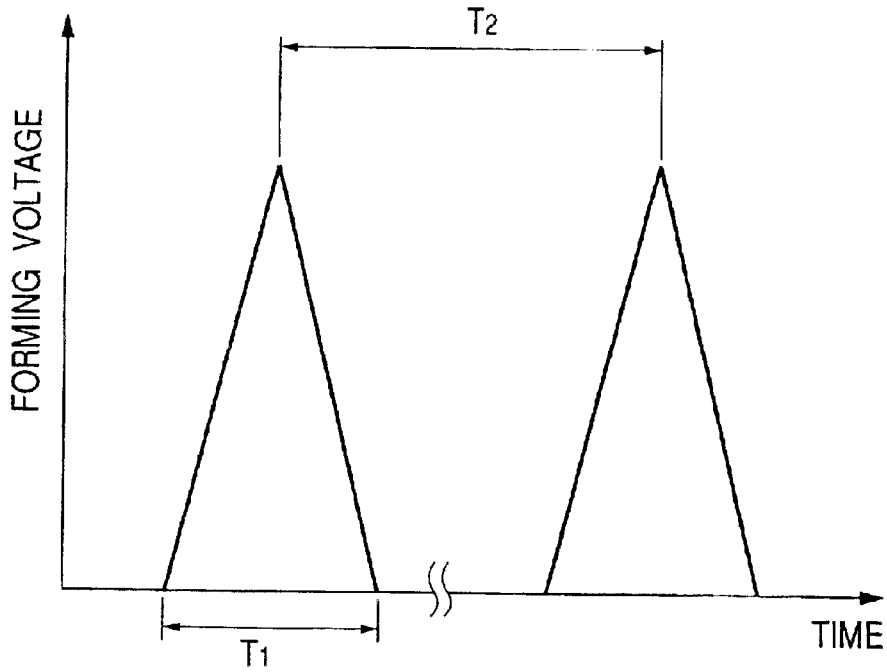
FIGS. 6A and 6B are schematic views of a pulse voltage wave used for the manufacture of the electron source according to the present invention.

T1 and T2 in FIG. 6A are the pulse width and the pulse interval of the voltage wave. Usually, T1 is set within the range of 1 $\mu$sec. to 10 msec., while T2 is set within the range of 10 $\mu$sec. to 100 msec. The crest value of a chopping wave (peak voltage at the time of energization forming) is suitably chosen according to an electron-emitting device form. Under such a condition, for example, the voltage is applied for a few seconds to scores of minutes. The pulse wave form is not limited to the chopping wave, but any desired wave form such as a rectangular wave and the like can be adapted.

Figure 6B:
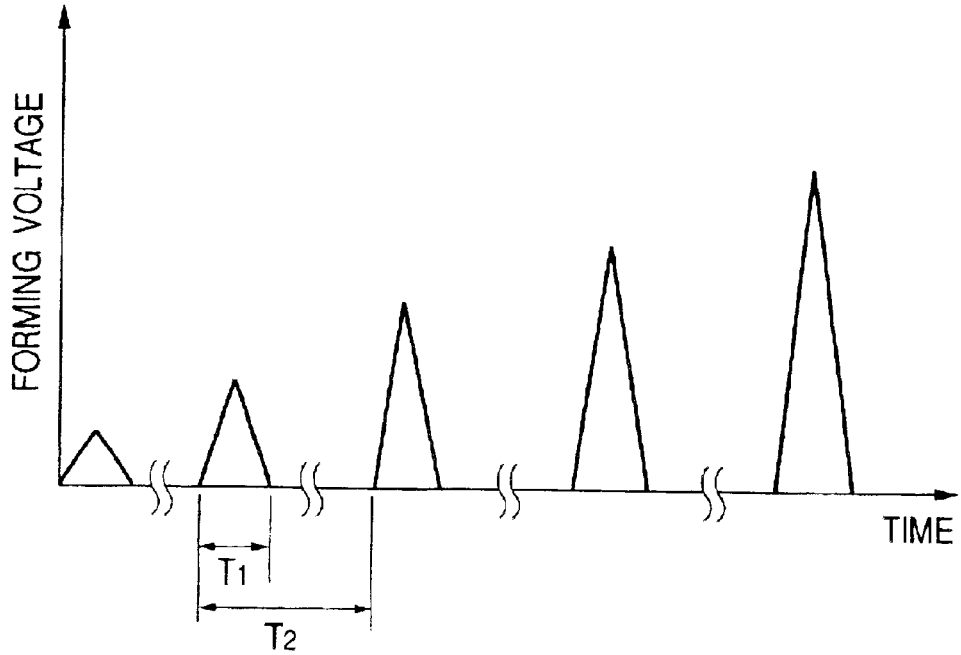

T1 and T2 in FIG. 6B can be taken as the same as those shown in FIG. 6A. The crest value of the chopping wave (peak voltage at the time of energization forming) can be, for example, increased approximately by 0.1 V/step at a time. The energization forming operation completes when, for example, a resistance of approximately 0.1 V is shown in the pulse interval T2.

It is preferable to treat the device which completed the forming with a processing referred to as an activation step. What is meant by the activation step is a step where a device current If, an emission current Ie change greatly by virtue of this step.

The activation step can be performed, for example, by repeating the application of the pulses similar to the energization forming under the atmosphere containing the gas of an organic substance. This atmosphere not only can be formed by utilizing the organic gas remained inside the atmosphere when the inside of a vacuum container is exhausted of an air by using an oil diffusion pump, a rotary pump and the like, but also can be obtained by introducing suitable gas of the organic substance into vacuum exhausted of an air once sufficiently by an ion pump and the like. The preferable gas pressure of the organic substance at this time differs depending on the above described application form, the shape of the vacuum container, the type of organic substance and the like and therefore is set suitably as occasions demand. For suitable organic substance, organic acid class and the like such as alkene, aliphatic hydrocarbon class of alkyne, aromatic hydrocarbon class, alcohol class, aldehyde class, ketone class, amine class, phenol, carboxylic acid, sulfonic acid and the like can be enumerated. To be concrete, methane, ethane, saturated hydrocarbon represented by $C_nH_{2n+2}$ such as propane and the like, ethylene, unsaturated hydrocarbon represented by the composition formula of $C_nH_{2n}$ and the like of propylene and the like, benzene, toluene, methanol, ethanol, formaldehyde, acetaldehyde, acetone, methylethylketone, methylamine, ethylamine, phenol, formic acid, acetic acid, propionic acid or mixtures of the above described can be used. As a result of this processing, the carbon film from the organic substance existing in the atmosphere is deposited on the device and the device current If, the emission current Ie change greatly.

To judge the completion of the activation step is suitably performed while measuring the device current If and the emission current Ie. Note that the pulse width, the pulse interval, the pulse crest value and the like are suitably set.

The above described carbon film is, for example, a film of graphite (which contains so-called HOPG, PG, GC. HOPG indicates an approximately complete crystal structure of graphite, PG a slightly distorted crystal structure having crystal grains of approximately 20 nm and GC a much more distorted crystal structure having crystal grains of approximately 2 nm) and noncrystalline carbon (which indicates amorphous carbon and mixtures of amorphous carbon and the above described graphite) and the thickness thereof is preferably equal to or less than 50 nm and more preferably equal to or less than 30 nm.

In such a manner as described above, the electron source as shown in FIGS. 2A and 2B are manufactured.

An example of the electron source where a plurality of electron-emitting devices are arranged, and the image forming apparatus using this electron source as another embodiment of the electron source formed by using the above described electron source forming substrate will be described as follows.

Figure 7:
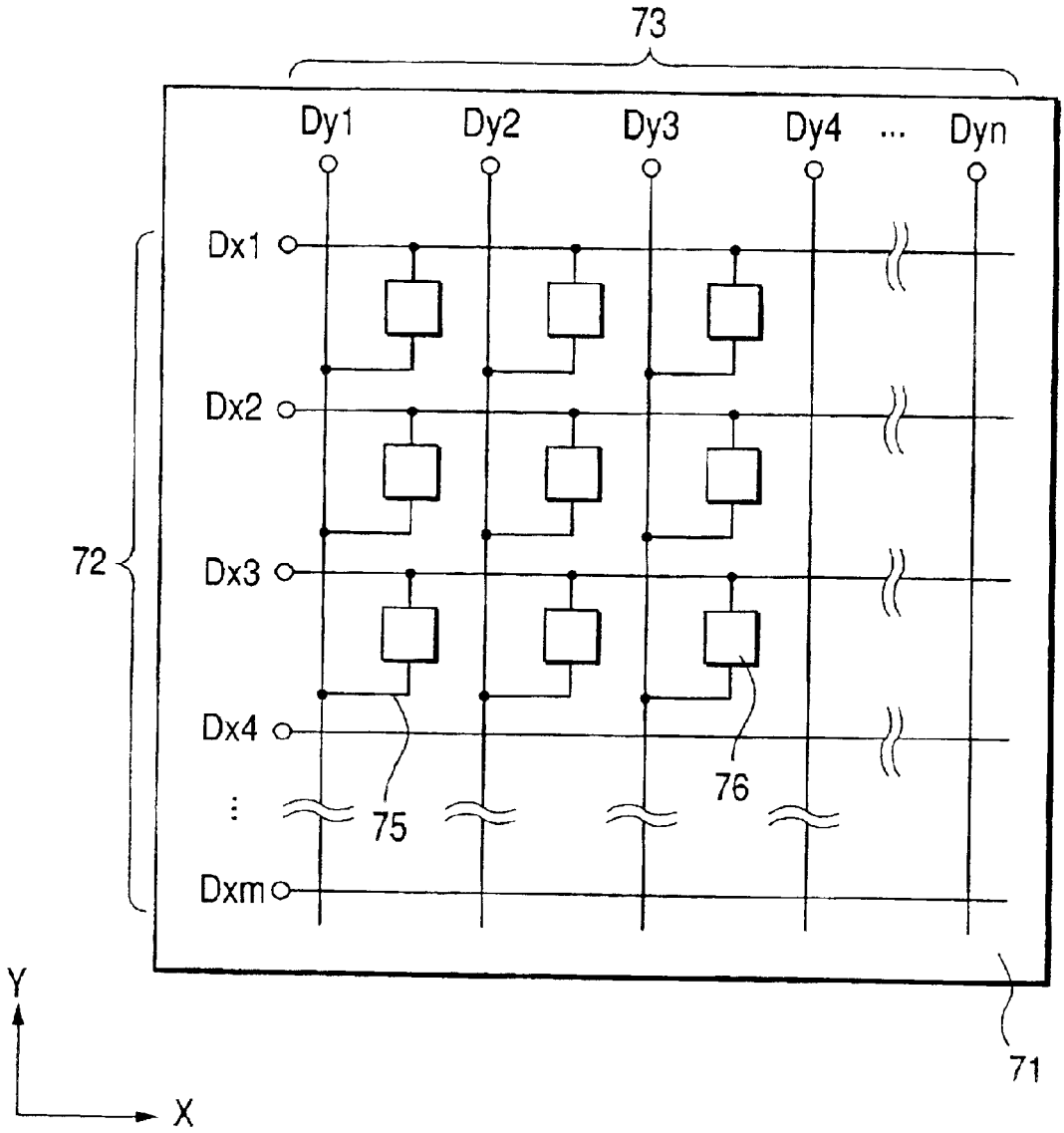
FIG. 7 is a schematic view showing one configuration example of the electron source of the present invention.

FIG. 7 is a type view showing the electron source where a plurality of electron-emitting devices are matrix-wired on the electron source forming substrate as shown in the above described FIG. 1. In FIG. 7, reference numeral 71 denotes the substrate and the above described first layer and the second layer are disposed there in advance. Reference numeral 72 denotes a row-directional wiring, reference numeral 73 a column-directional wiring. Also, reference numeral 76 denotes the electron-emitting device and reference numeral 75 a connection.

The row-directional wirings 72 of m pieces comprise $D_{x1}$, $D_{x2}$, . . . , $D_{xm}$ and can be constructed of a conductive metal and the like formed by using the vacuum evaporation method, the printing method, the sputtering method and the like. The column-directional wiring 73 is constructed of the n number of $D_{y1}$, $D_{y2}$, . . . , $D_{yn}$ and formed similar to the row-directional wiring 72. Between the m number of row-directional wirings 72 and the n number of column-directional wirings 73, there is disposed an interlayer insulating layer (not shown) which electrically separates both of the lines (Both m and n are positive integers).

The interlayer insulating layer is constituted by $SiO_2$ and the like formed by using the vacuum evaporation method, the printing method, the sputtering method and the like. For example, the whole or a part of the electron source substrate 71 where the column-directional wirings 73 are formed is formed according to a desired shape and, in particular, the film thickness, the material and the manufacturing method are suitably set so as to be able to endure the electric potential difference of the crossing portion of the row-directional wiring 72 and the column-directional wiring 73.

The row-directional wiring 72 and the column-directional wiring 73 are pulled out respectively as external terminals.

The electron-emitting devices 76 are electrically connected to the m number of row-directional wirings 72 and the n number of column-directional wirings 73 by the connections 75 comprising the conductive metal and the like.

To the row-directional wirings 72, scanning signal applying means (not shown) for applying scanning signal for choosing the rows of the electron-emitting device 76 arranged in the X direction is connected. On the other hand, to the column-directional wirings 73, modulation signal generating means (not shown) for modulating each column of the electron-emitting device 76 arranged in the Y direction according to input signal is connected. The drive voltage applied to each electron-emitting device is supplied as a difference voltage between scanning signal and modulation signal applied to the above described devices.

In the configuration of the above described electron source, by using simple matrix-wirings, a plurality of surface conduction electron-emitting devices were simply matrix-wired on the above described electron source forming substrate.

Next, the image forming apparatus constructed by using the above described electron source will be described by using FIG. 8 and FIGS. 9A and 9B as well as FIG. 10.

Figure 8:
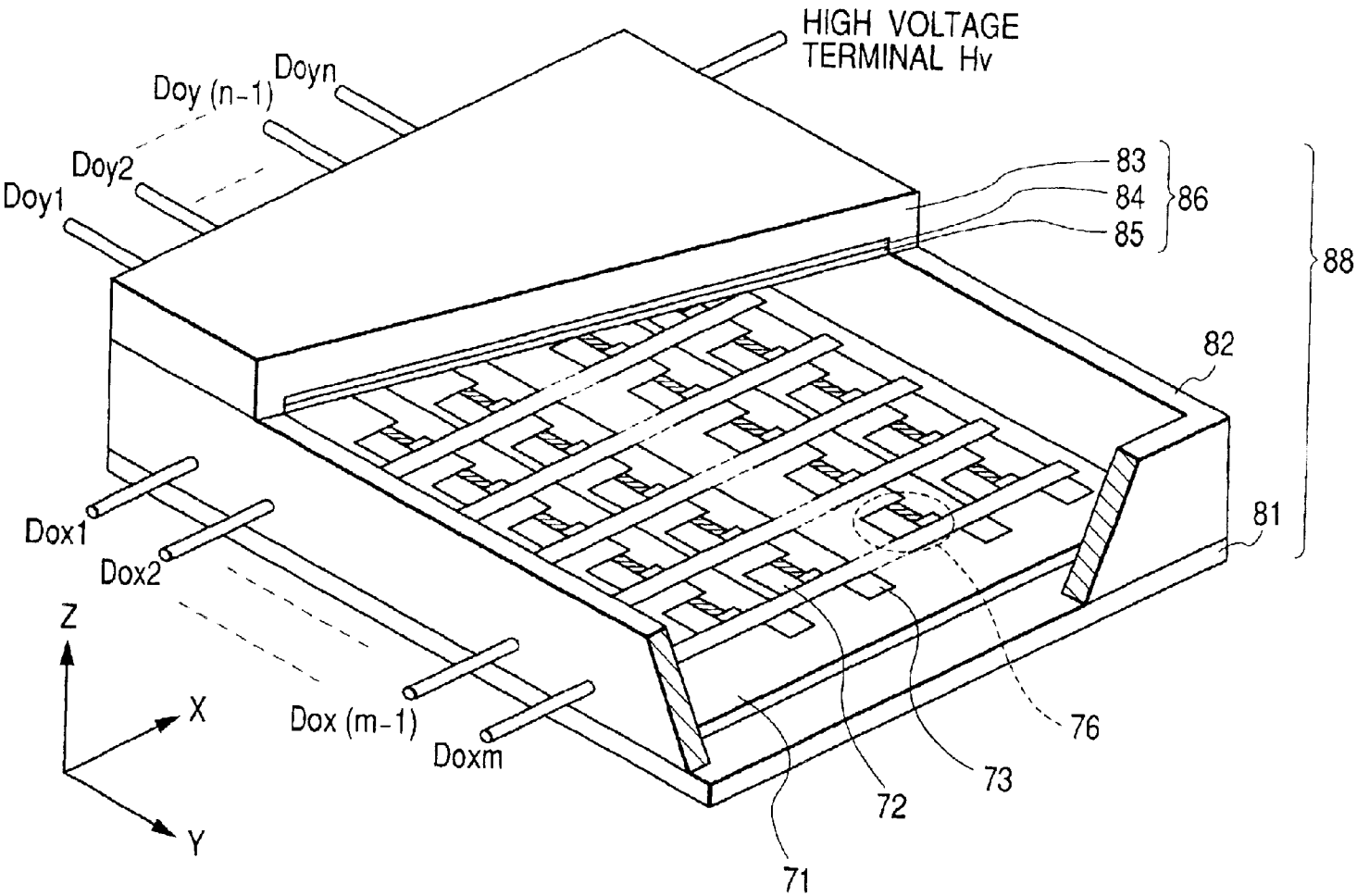
FIG. 8 is a schematic view showing one configuration example of an image forming apparatus of the present invention.

FIG. 8 is a type view showing one example of the display panel of the image forming apparatus. FIGS. 9A and 9B are schematic views of the fluorescent screen used by the image forming apparatus of FIG. 8. FIG. 10 is a block diagram showing one example of the drive circuit for performing display according to television signals of NTSC system.

In FIG. 8, reference numeral 71 denotes the above described substrate as shown in FIG. 7 where a plurality of surface conduction electron-emitting devices 76 are arranged, reference numeral 81 a rear plate fixing the substrate 71, reference numeral 86 a faceplate where the fluorescent screen 84 and a metal back 85 are formed in the inner surface of a glass substrate 83. Reference numeral 82 a support frame. To this support frame 82, the rear plate 81, the faceplate 86 are connected by using the frit glass of a low fusion point.

Reference numerals 72, 73 denote the row-directional wiring and the column-directional wiring connected to the surface conduction electron-emitting device 76.

An envelope 88 is, as described above, constituted by the faceplate 86, the support frame 82 and the rear plate 81. The rear plate 81 is mainly disposed for the purpose of reinforcing the strength of the substrate 71 and therefore when the substrate 71 has sufficient strength by itself, the rear plate 81 as a separate member can be dispensed with. That is, the support frame 82 is seal-bonded directly to the substrate 71 and a support member not shown referred to as a spacer is disposed between the faceplate 86, the rear plate 81, thereby enabling to constitute the envelope 88 having sufficient strength against the atmospheric pressure.

Figure 9A:
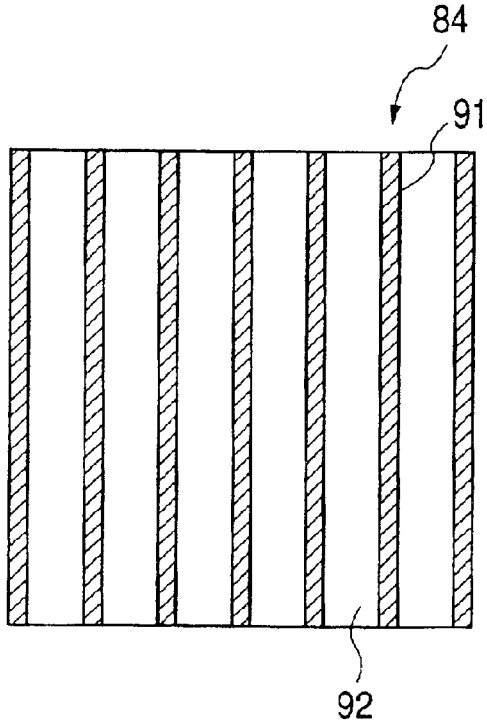
FIGS. 9A and 9B are schematic views showing the configuration of a fluorescent screen used for the image forming apparatus of the present invention.
Figure 9B:
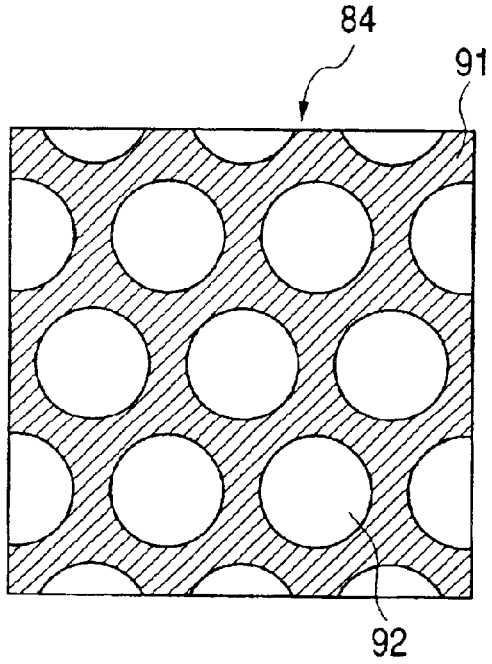
Figure 10:
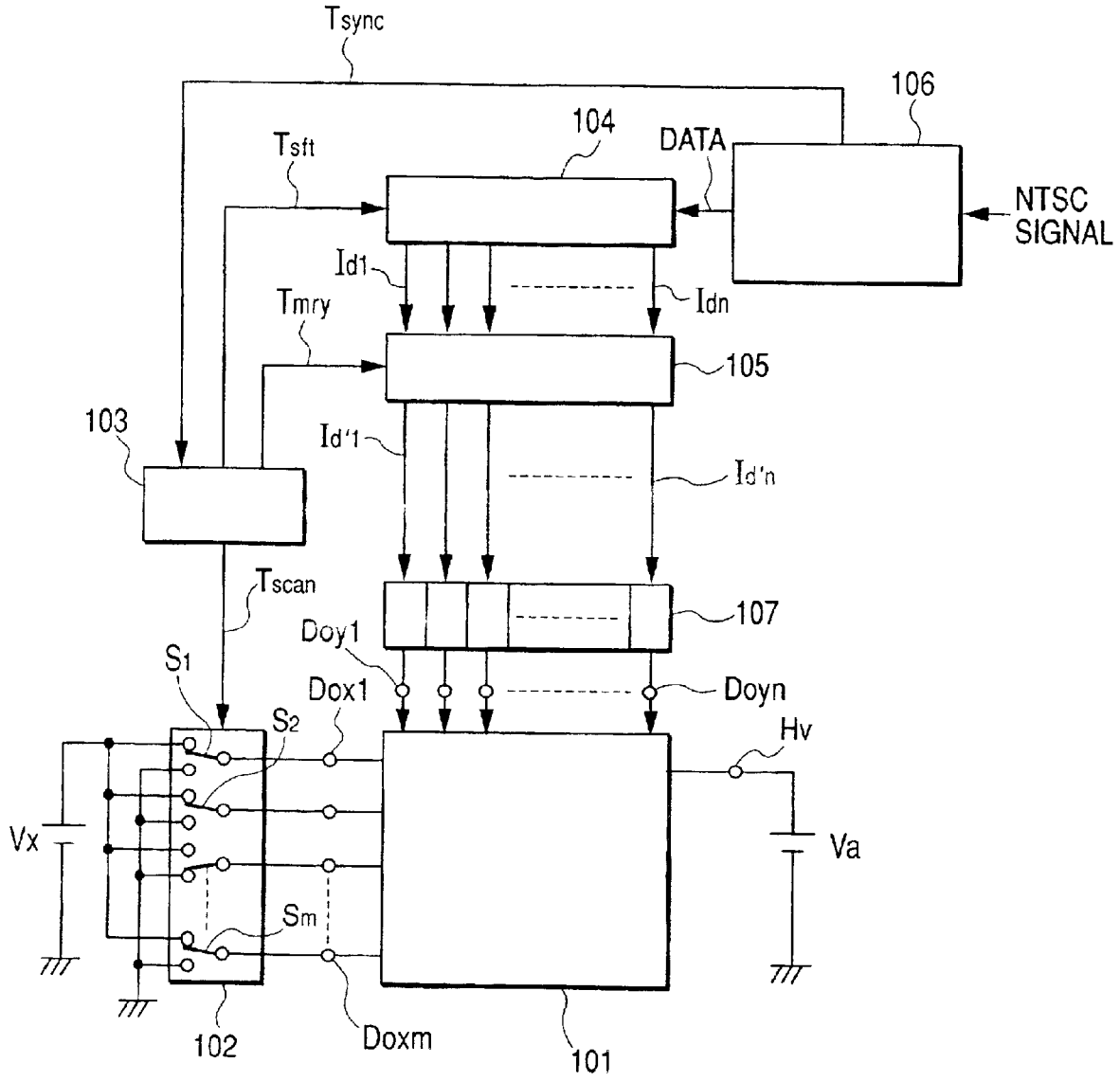
FIG. 10 is a block diagram showing one example of a drive circuit.

FIGS. 9A and 9B are schematic views showing the fluorescent screen. The fluorescent screen 84 can be composed of phosphorus alone in the case of a monochrome screen. In the case of a color fluorescent screen, it can be composed of a black conductive material 91 and a phosphor 92 respectively referred to as a black stripe (FIG. 9A) and a black matrix (FIG. 9B). The purpose of disposing the black stripe and the black matrix is to make color mixtures and the like inconspicuous by blacking non-applied portion among each phosphor 92 of the primary color phosphors which are required in the case of the color display and to control the lowering of contrast by external light reflection in the fluorescent screen 84. For the material of the black conductive material 91, in addition to the material comprising black lead commonly used as the principal component, the material which is electronically conductive and has a little light permeation and reflection can be used.

The method of applying phosphor on the glass substrate can adapt a precipitation method, the printing method and the like regardless of monochrome or color.

On the inner surface side of the fluorescent screen 84, usually the metal back 85 is disposed. The purpose of disposing the metal back is to improve brightness by mirror face-reflecting light toward the inner surface side to the faceplate 86 side from among luminance of the phosphor, to make the metal back act as an electrode for applying an electron beam accelerating voltage and to protect the phosphor from damages by collision of negative ion generated inside the envelope and the like. The metal back can be prepared, after the preparation of the fluorescent screen, by performing a smoothing processing (usually referred to as "filming")of the surface of the inner surface side of the fluorescent screen and thereafter by depositing Al by using the vacuum evaporation and the like.

In the faceplate 86, in order to further enhance conductivity of the fluorescent screen 84, a transparent electrode (not shown) may be disposed at the outer surface side of the fluorescent screen 84.

When performing the above described seal bonding, it is necessary to allow each color phosphor and the electron-emitting device to correspond and sufficient positioning is indispensable.

One example of the manufacturing method of the image forming apparatus as shown in FIG. 8 will be described as follows.

Figure 11:
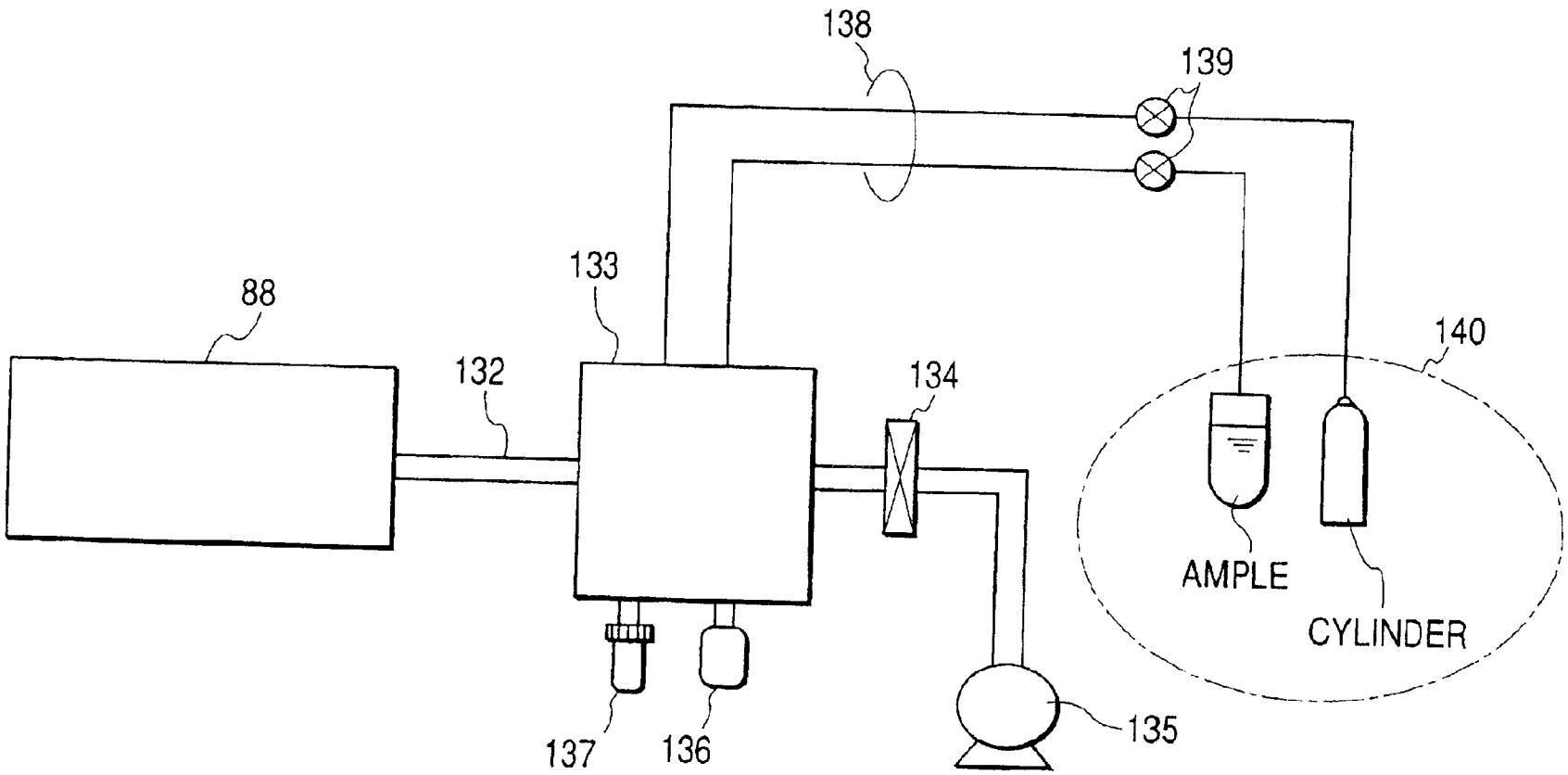
FIG. 11 is a schematic view showing the outline of a system used for the manufacture of the image forming apparatus.

FIG. 11 is a schematic view showing the outline of the apparatus used in this process. The envelope 88 is connected to a vacuum chamber 133 through an exhaust pipe 132 and further connected to an exhauster 135 through a gate valve 134. To the vacuum chamber 133, in order to measure the pressure of the inside thereof and the partial pressure of each compound in the atmosphere, a pressure gage 136, a quartet pole mass spectrograph 137 and the like are fixed. Because direct measurement of the pressure and the like inside the envelope 88 is difficult, the pressure and the like inside the vacuum chamber 133 are used as replacement. To the chamber 133, in order to further control the atmosphere by introducing necessary gas into the vacuum chamber, a gas introducing line 138 is connected. To the other end of this gas introducing line 138, an introducing material source 140 is connected and the introducing material is put into a ample, a cylinder and the like and stored there.

Halfway along the gas introducing line 138, introducing means 139 for controlling a rate of introducing the introducing material is disposed. This introducing amount control means can use, to be concrete, a valve capable of controlling the quantity of flow to escape such as a slow leak valve and a mass flow controller and the like, respectively according to the type of the introducing material.

Figure 12:
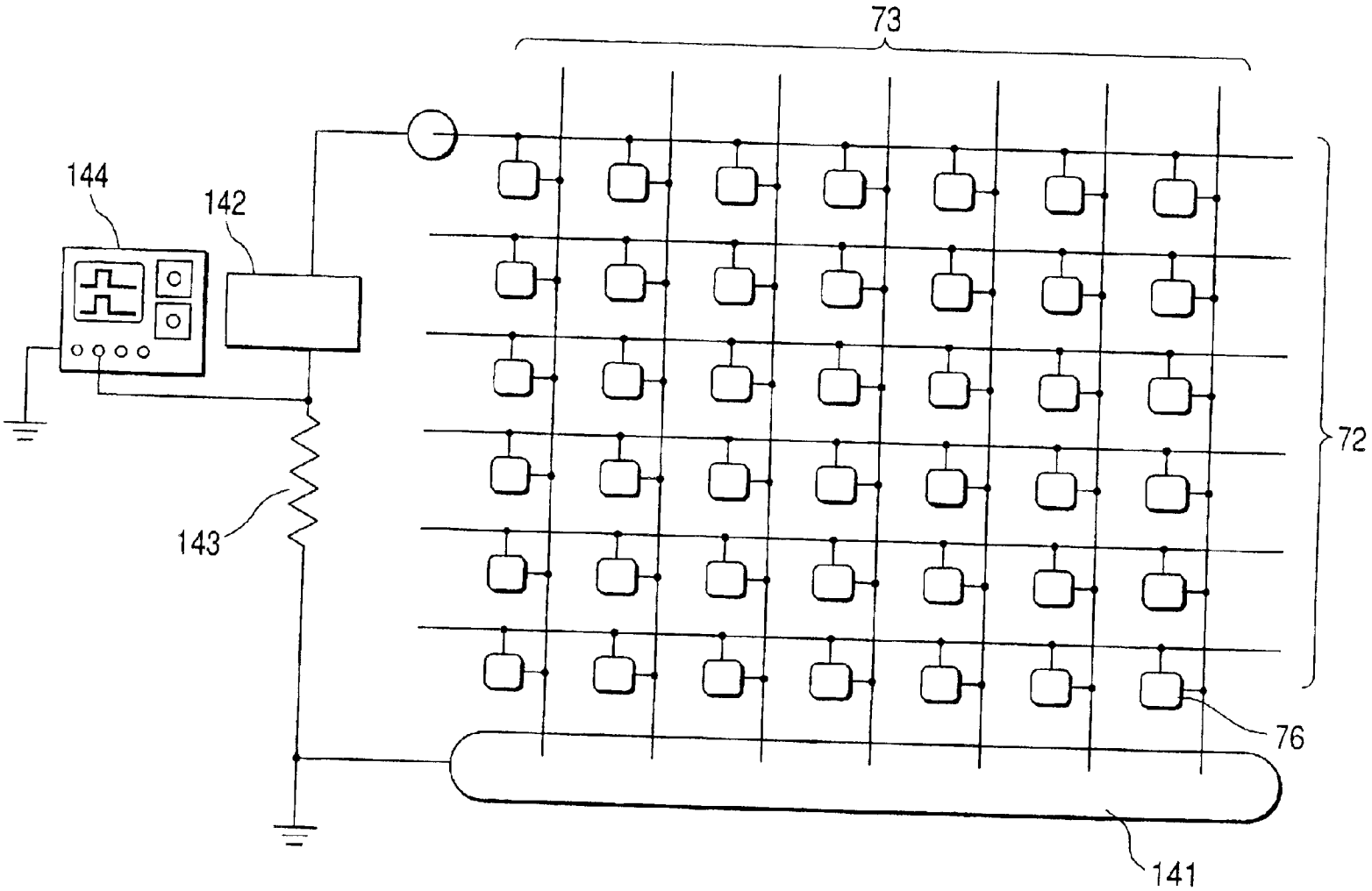
FIG. 12 is a drawing showing a wiring method for a forming and an activation step of the image forming apparatus of the present invention.

The inside of the envelope 88 is exhausted of an air by the apparatus of FIG. 11 and the forming is performed. At this time, for example as shown in FIG. 12, the column-directional wirings 73 are connected to a common electrode 141 and, to the device connected to one of the row-directional wirings 72 is applied with voltage pulse by an power source 142 at the same time so that the forming can be performed. The conditions such as the shape of the pulse, the judgment of the completion of the processing and the like may be chosen according to the method previously described in relation to the forming of each device. Also, by sequentially applying (scrolling) the pulse shifted in phase to a plurality of row-directional wirings, the forming of the devices connected to a plurality of row-directional wirings can be collectively performed. In the drawing, reference numeral 143 denotes an electrical current measuring resistor and reference numeral 144 an electrical current measuring oscilloscope.

After the forming is completed, the activation step is performed. After the envelope 88 is sufficiently exhausted of an air, an organic material is introduced there from the gas introducing line 138. Or, as an activating method of the individual device as described above, first the exhaust is performed by the oil diffusion pump or the rotary pump, and then the resultant organic material remained inside the vacuum atmosphere may be used. There is a case when materials other than the organic material are introduced as required. In the atmosphere formed in such a manner with the organic material contained therein, a voltage is applied to each electron-emitting device so that carbon or carbon compound or mixtures of both deposits on the electron-emitting portion, thereby raising an electron-emitting amount drastically. This is similar to the case of the individual device. The voltage applying method at this time is such that the voltage pulse may be applied to the devices connected in one row-directional wiring at the same time by the connection similar to the case of the individual device. Also by sequentially applying (scrolling) the pulse shifted in phase to a plurality of row-directional wirings, the devices connected to a plurality of row-directional wirings can be collectively activated and in such a case the device current can be aligned to each row-directional wiring.

After the activation step is completed, it is preferable that a stabilization step is performed similar to the case of the individual device.

This step is a step for vacuum-exhausting the inside of the envelope 88 where the electron-emitting devices are arranged. To be concrete, the envelope 88 is heated and while maintaining the temperatures at 80° C. to 250° C., the exhaust is performed by an exhauster 135 which does not use oil such as the ion pump, a sorption pump and the like through an exhaust pipe 132 and after the atmosphere is restored where the organic material is sufficiently reduced, the exhaust pipe is heated and melted by a burner and the envelope is sealed.

To maintain the pressure after the envelope 88 is sealed, a getter processing can be also performed. This is a processing where right after or before the sealing of the envelope 88 is performed, by resistance-heating or heating by using high frequency heating and the like, the getter arranged at a predetermined position (not shown) inside the envelope 88 is heated, thereby forming a seal bonding film. Usually, the getter has Ba and the like as the principal component and maintains the atmosphere inside the envelope 88 by absorption action of the seal bonding film.

Next, the configuration example of the drive circuit for performing television display based on television signals of NTSC system on the display panel constructed by using the electron source of the simple matrix arrangement will be described by using FIG. 10. In FIG. 10, reference numeral 101 denotes an image display panel as shown in FIG. 8, reference numeral 102 a scanning circuit, reference numeral 103 a control circuit, reference numeral 104 a shift resistor. Reference numeral 105 denotes a line memory, reference numeral 106 a synchronizing signal isolation circuit, reference numeral 107 a modulation signal generator and reference symbols Vx and Va direct current voltage sources.

The display panel 101 is connected to external electric circuits through terminals $D_{ox1}$ to $D_{oxm}$, terminals Doy 1 to Doyn and a high voltage terminal Hv. To the terminals $D_{ox1}$ to $D_{oxm}$, the scanning signals are applied for sequentially driving the electron sources disposed inside the display panel, that is, the electron-emitting device group matrix-wired in the matrix of m row and n column by one row (n devices) at a time.

To the terminals $D_{oy1}$ to $D_{oyn}$, modulation signals are applied for controlling the outputted electron beams of each device of the electron-emitting devices of one row chosen by the above described scanning signals. To the high voltage terminal Hv, the direct current voltage of, for example, 10 kV is applied by the direct current voltage source Va. This is an accelerating voltage for giving sufficient energy to excite phosphor for electron beams discharged from the electron-emitting devices.

The scanning circuit 102 will be described. This circuit comprises the m number of switching devices (typically shown by Sl to Sm in the drawing) inside. Each switching device chooses either of the output voltage of the direct current voltage source Vx or OV (ground level) and is electrically connected to the terminals $D_{ox1}$ to $D_{oxm}$ of the display panel 101. Each switching device of S1 to Sm operates based on the control signal Tscan which the control circuit 103 outputs and can be constructed by combining the switching device such as, for example, FET.

The direct current voltage source Vx is set so as to output a fixed voltage in such a manner that the drive voltage applied to the device which is not scanned based on the characteristics (electron-emitting threshold value voltage) of the electron-emitting device becomes below an electron-emitting threshold value voltage.

The control circuit 103 is provided with a function for coordinating the operation of each portion to perform suitable display based on image signals inputted from the outside. The control circuit 103 generates each control signal of Tscan and Tsft and Tmry for each portion based on the synchronizing signal Tsync transmitted from the synchronizing signal isolating circuit 106.

The synchronizing signal isolating circuit 106 is a circuit for isolating synchronizing signal components and luminance signal components from the television signals of NTSC system inputted from the outside. The synchronizing signals isolated by the synchronizing signal isolating circuit 106 comprise vertical synchronizing signal and horizontal synchronizing signal. Here, however, for the sake of the description, they were shown as Tsync. The luminance signal components of the images isolated from the above described television signals were expressed as DATA signals for the convenience's sake. This DATA signals are inputted into the shift register 104.

The shift register 104 is for performing serial/parallel conversion of the above described DATA signals serially inputted in time series for each one line of the images and operates based on the control signal Tsft transmitted from the above described control circuit 103 (That is, the control signal Tsft can be said to be the shift lock of the shift register 104). The data of one line portion of the images serial/parallel-converted (which correspond to the drive data of the n number of electron-emitting devices) is outputted from the above described shift resistor 104 as n pieces of parallel signals of 1*d*1 to 1*d*n.

The line memory 105 is an apparatus for storing the data of one line portion of the images for a required length of time and suitably stores the contents of 1*d*1 to 1*d*n according to the control signal Tmry transmitted from the control circuit 103. The contents stored are outputted as Id'1 to Id'n and inputted into the modulation signal generator 107.

The modulation signal generator 107 is a signal source for driving and modulating each of the surface conduction electron-emitting devices according to each of the image data Id'1 to Id'n and its output signals are applied to the surface conduction electron-emitting devices inside the display panel 101 through the terminals $D_{oy1}$ to $D_{oyn}$.

Here, the above described surface electron-emitting devices have the following basic characteristics for the emission current le. That is, the electron emitting has a definite threshold value voltage Vth and only when the voltage equal to or more than Vth is applied, electron-emitting occurs. For the voltage equal to or more than the electron-emitting threshold value, the electron-emitting changes according to the change of the applied voltage to the device. From this fact, when the pulse shaped voltage is applied to this device, even if the voltage less than the electron-emitting threshold value is, for example, applied, the electron-emitting does not occur. However, when the voltage equal to or more than the electron-emitting threshold value is applied, electron beams are outputted. At this time, by changing a pulse crest value Vm, the strength of the outputted electron beams can be controlled. Also, by changing a pulse width Pw, an electric charge amount of electron beams outputted can be controlled. Accordingly, for the system for modulating the electron-emitting devices according to inputted signals, a voltage modulating system, a pulse width modulating system and the like can be adapted. When the voltage modulating system is employed, the circuit of the voltage modulation system can be used as the modulation signal generator 107, wherein the voltage pulse of a fixed length is generated and the pulse crest value is suitably modulated according to the inputted data.

When the pulse width modulation system is employed, the circuit of the pulse width modulation system can be used as the modulation signal generator 107, wherein the voltage pulse of a fixed crest value is generated and the width of the voltage pulse is modulated according to the inputted data.

The shift register 104 and the line memory 105 can adapt a digital signal system and an analogue signal system because the serial/parallel conversion and memory of the image signals can be effective if performed at a predetermined speed.

When the digital signal system is employed, the output signal DATA of the synchronizing signal isolating circuit 106 is required to be digitalized. For this purpose, an A/D converter may be disposed in the output portion of the synchronizing signal isolating circuit 106. In this respect, the circuit used in the modulation signal generator 107 becomes slightly different depending on whether the output signal of the line memory 105 is digital signal or analogue signal. That is, in the case of the voltage modulation system using the digital signal, for the modulation signal generator 107, for example, the D/A conversion circuit is used and an amplifying circuit is added as occasions demand. In the case of the pulse width modulation system, for the modulation signal generator 107, for example, a circuit which combines a counter (counter) for counting the number of waves outputted from a high speed oscillator and an oscillator and a comparator (comparator) for comparing the output values of the counter and the output values of the above described memory is used. As occasions demand, an amplifier for amplifying the voltage of the modulation signal modulated pulse width-wise outputted from the comparator to a level of the drive voltage of the surface conduction electron-emitting device can be added.

In the case of the voltage modulation system using the analogue signal, for the modulation signal generator 107, for example, the amplifying circuit using an operational amplifier and the like can be adapted and a level shift circuit can be added as occasions demand. In the case of the pulse width modulation system, for example, a voltage control oscillating circuit (VOC) can be adapted and the amplifier for amplifying the voltage to a level of the drive voltage of the surface conduction electron-emitting device can be added as occasions demand.

In the image display apparatus capable of adapting the present invention capable of having such a configuration, by applying the voltage to each electron-emitting device through the container outside terminals $D_{ox1}$ to $D_{oxm}$, Doy 1 to Doy n, electron-emitting occurs. A high voltage is applied to the metal back 85 or the transparent electrode (not shown) through the high voltage terminal Hv and electron beams are accelerated. The accelerated electron collides with the fluorescent screen 84 and luminance is generated so as to form the image.

Next, the electron source where a plurality of electrons are arranged ladder-like on the electron source forming substrate as shown in the above described FIG. 1 and the image forming apparatus using such an electron source as still another embodiment of the electron source formed by using the above described electron source forming substrate will be described by using FIG. 13 and FIG. 14.

Figure 13:
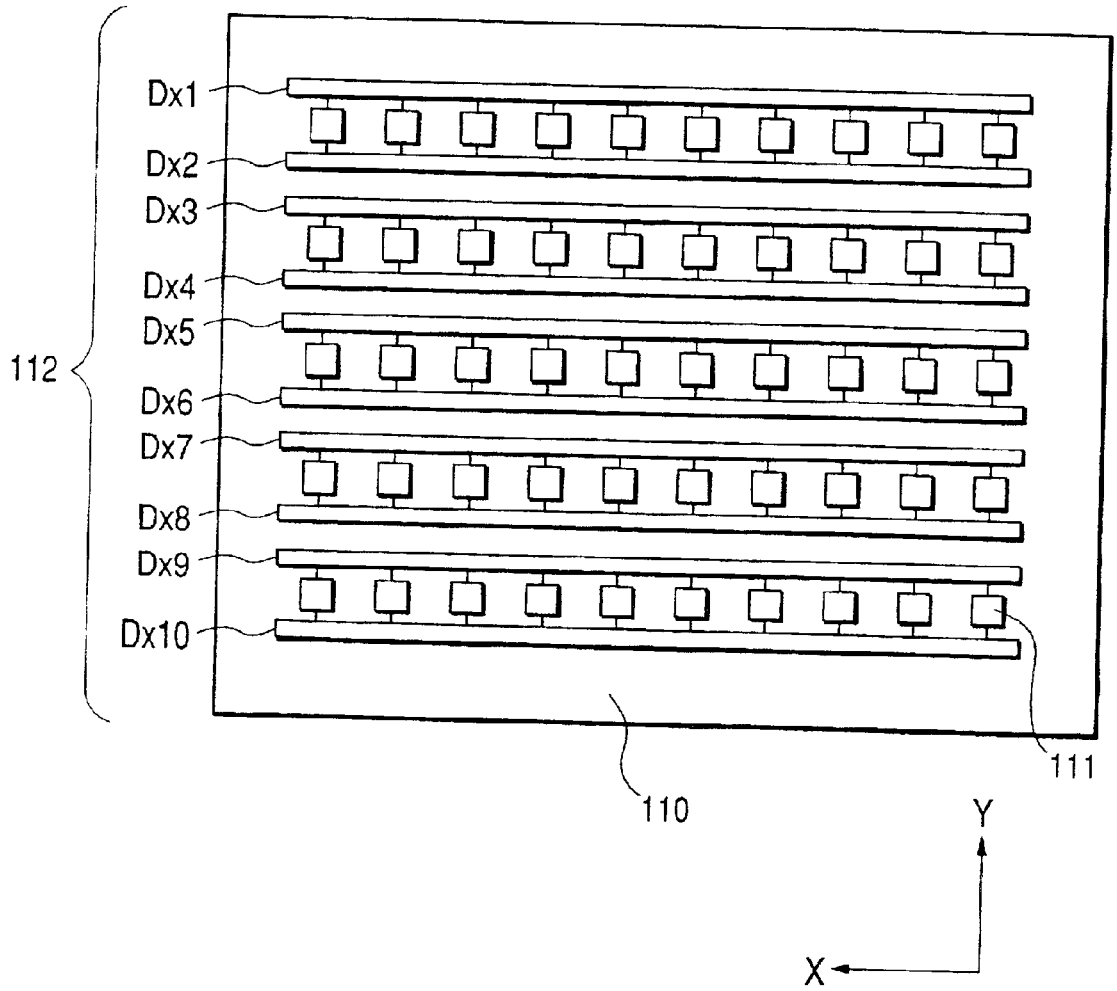
FIG. 13 is a schematic view showing another configuration of the electron source of the present invention.

FIG. 13 is a type view showing one example of the electron sources arranged ladder-like. In FIG. 13, reference numeral 110 denotes the substrate where the above described first layer and second layer are formed in advance and reference numeral 111 denotes the surface conduction electron-emitting device. Reference numeral 112 ($D_{x1}$ to $Dx_{x10}$) denotes a common wiring for connecting the surface conduction electron-emitting devices 111.

The surface conduction electron-emitting device 111 is arranged in plural pieces in parallel with the X direction on the substrate 110 (which is referred to as device). A row of this device is arranged in plurality so as to form the electron source. By applying the drive voltage between the common wiring of each device row, each device row can be independently driven. That is, to the device row which is desired to discharge electron beams, the voltage equal to or more than the electron emitting threshold value is applied and to the device which does not discharge electron beams, the voltage less than the electron emitting threshold value is applied. The common wiring between each device row $D_{x2}$ to $D_{x9}$ can also take, for example, $D_{x2}$, $D_{x3}$ as the same wiring.

Figure 14:
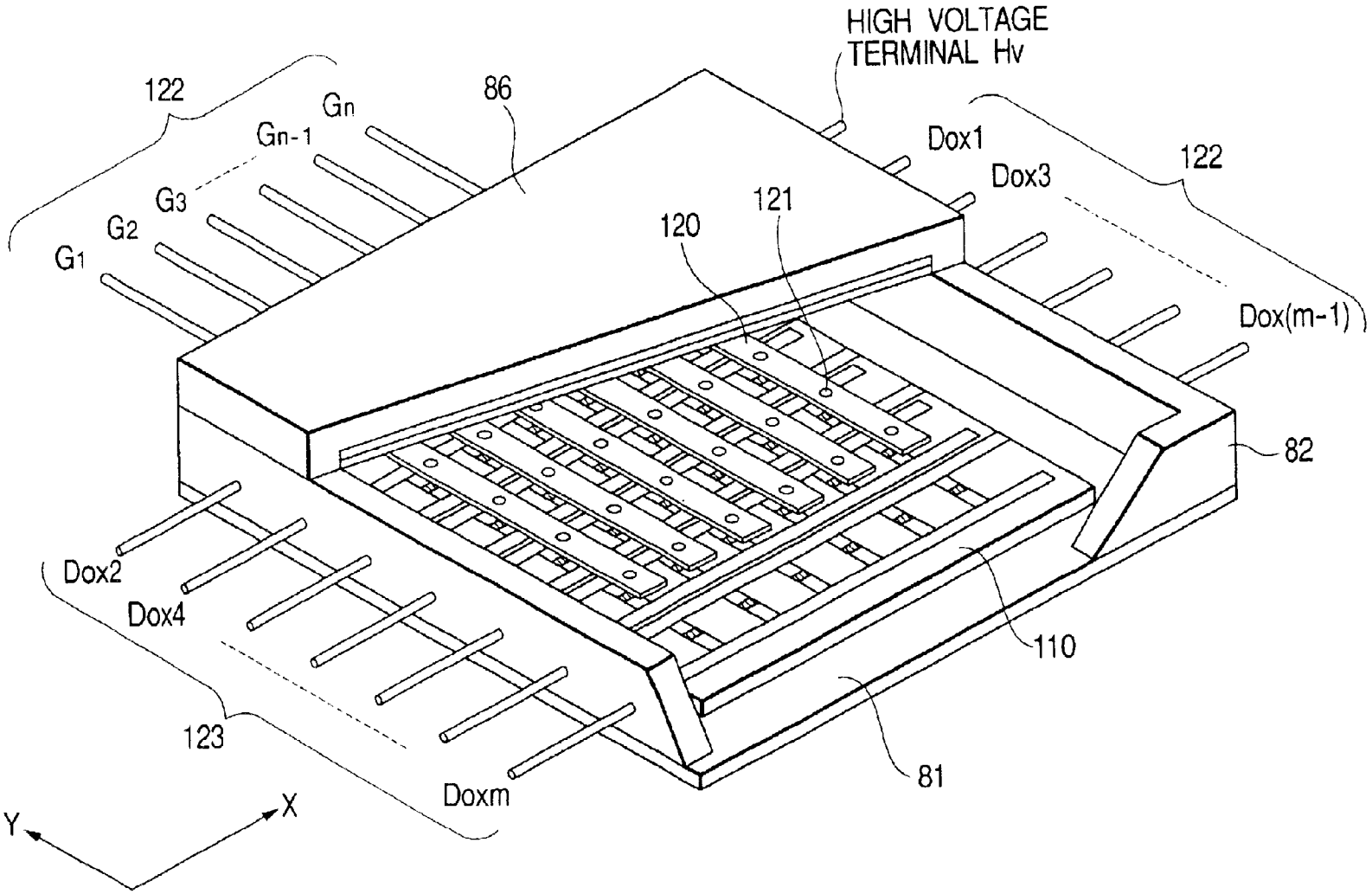
FIG. 14 is a schematic view showing the other configuration of the image forming apparatus of the present invention.

FIG. 14 is a type view showing one example of the panel structure in the image forming apparatus comprising the ladder-like electron source. Reference numeral 120 denotes a grid electrode, reference numeral 121 an opening for electron to pass through, reference numeral 122 denotes the container outside terminals comprising $D_{ox1}$, $D_{ox2}$, . . . , $D_{oxm}$. Reference numeral 123 denotes the container outside terminals which are connected to the grid electrodes 120 and comprise G1, G2, . . . , Gn, reference numeral 110 the electron source substrate which takes common wirings between each device row as the same wiring.

In FIG. 14, the same reference numeral is attached to the same portion as the portion shown in FIG. 8, FIG. 13. The major difference with the image forming apparatus of simple matrix arrangement as shown in FIG. 8 is whether the grid electrode 120 is provided between the electron source substrate 110 and the faceplate 86.

The grid electrode 120 is for modulating electron beams discharged from the electron-emitting device and in order to pass the electro beams through stripe-shaped electrodes, disposed orthogonal to the device row arranged ladder-like and therefore provided with a circular opening 121 corresponding to each device one by one. For this opening 121, for example, a number of passage outlets can be disposed on a mesh and the grid can be disposed in the vicinity of, or adjacent to the electron-emitting device.

The container outside terminal 122 and the grid container outside terminal 123 are electrically connected to control circuits (not shown).

The image forming apparatus of the present example applies modulation signal of one line portion of the image to the grid electrode column at the same time, while synchronizing with sequential driving (scanning) of the device rows one column by one column. This controls irradiation of each electron beam to the phosphor and can display the image one line by one line.

The configurations of tow types of the image forming apparatuses described herein are one example of the image forming apparatus capable of adapting the present invention and can be variously modified based on the technical idea of the present invention. With respect to the input signals, though NTSC system was enumerated, the input signals are not limited to this, but in addition to PAL, SECAM systems and the like, other systems such as TV (for example, high definition TV) signals system comprising greater number of scanning lines than those of the above described can be also adapted.

The image forming apparatus of the present invention can be used also as the image forming apparatus and the like as an optical printer constructed by using a sensitive drum and the like in addition to the display device of television broadcasting, television conference system, computers and the like.

EXAMPLE

Hereinafter, though the present invention will be described in detail by enumerating specific examples, the present invention is not limited to these examples, but includes those modified by replacement and design change of each constituent within the range of achieving the purpose of the present invention.

It is to be noted that analysis of sodium concentration in the following embodiments was performed by using SIMS analyzer (made by Physical Electronics Corporation, Product No. 6650). The measurement was performed in such a manner that the range of 2 $\mu$m×4 $\mu$m between electrodes was hit by ion beams at 6 KeV and sputtered and the resultant positive secondary ion was treated with mass spectrometry, thereby quantifying the concentration of each iron in a depth direction.

(Embodiment 1)

In the present embodiment, the electron source as shown in FIGS. 2A and 2B was manufactured according to the steps as shown in FIG. 5A to FIG. 5D. Note that, for the present embodiment as well as the embodiments and comparative examples to be described later, six pieces each of the device were prepared on the same substrate and repeatability of the Na diffusion control effect was examined.

(1) First, the electron source forming substrate as shown in FIG. 1 is prepared (FIG. 5A).

A high strain point glass (which contains $SiO_2$: 58%, $Na_2O$: 4%, $K_2O$: 7%) is fully cleaned and the following film was prepared thereon.

The film deposition method was such that each material solution was applied by a device referred to as a slit coater and drying of 80° C. was performed by using a hot plate. After that, baking of 500° C. for 60 minutes was performed.

Grains where $SnO_2$ is added with P of 2 atm % and baked approximately at 700° C. and pulverized are diffused in the solution comprising ethanol as the principal component. The average particle size of the diffused particles as expressed in the median value was 55 nm. Further, the solution added with silanol so that $SiO_2$ becomes approximately 15 wt % against $SnO_2$ was taken as application solution for the film becoming a first layer. The remaining solid portion after drying and baking is approximately 5 wt %. Note that the film thickness after the film deposition was 360 nm. This film material should be referred to as A class in the following.

The film which becomes a second layer used organic silicon compound solution. The solid portion after baking was approximately 2 wt %. The film thickness after the film deposition was 60 nm.

(2) Next, on the above described electron source forming substrate, the device electrodes 2, 3 are formed (FIG. 5B).

First, on the above described substrate, a photoresist layer is formed and an opening portion was formed corresponding to the shape of the device electrode on the photoresist layer by photolithography technique. On this, a film of Ti 5 nm, Pt 100 nm was deposited by the sputtering method and the above described photoresist layer was fused and removed by organic solution, thereby forming the device electrodes 2, 3 by lift off. At this time, a device electrode interval L shown in FIG. 2A was taken as 20 μm and an electrode length W as 600 μm.

(3) Next, between the above described each pair of device electrodes 2, 3, the conductive film 4 is formed (FIG. 5C).

First, the above was performed by applying an organic palladium contained solution in such a manner as to have a width of 90 μm by an ink jet injection equipment of the bubble jet method. After that, it was treated with a heating processing at 350° C. for 30 min. and the conductive film 4 containing oxide palladium grains was obtained.

Next, the wiring material which formed the wirings by screen printing for connecting the voltage to the above described device electrodes used NP-4035C silver paste made by NORITAKE and baked at 480° C. after printing.

Forming and activation were performed on the electron source prepared in the above described manner (FIG. 5D).

Naturally, to prepare the panel comprising the electron-emitting devices, many heating steps are subsequently required, but for the sake of experiments, the above described baking at 480° C. was decided to be performed three times as replacement.

When the surface sodium concentration (in the vicinity of approximately 30 nm) of the central portion between the device electrodes was analyzed, it became $1\times10^{19}$ atom/cm$^3$. This was reduced to equal to or less than one hundredth in contrast to the sodium concentration $1\times10^{21}$ atom/cm$^3$ in the high strain point glass and it was proved that the sodium block effect was great.

(Embodiments 2 to 4, Comparative Example 1)

Similar to the embodiment 1, the film as shown below was prepared and the temperature of sodium was measured.

TABLE 1

| | First layer (lower) | | Second layer (upper) | | |
|---|---|---|---|---|---|
| | | Film Thickness (nm) | | Film Thickness (nm) | Sodium Concentration (atom/cm$^3$) |
| Embodiment 2 | A-class | 360 | $SiO_2$ | 100 | $2\times10^{19}$ |
| Embodiment 3 | A-class | 360 | $SiO_2$ | 200 | $6\times10^{19}$ |
| Embodiment 4 | A-class | 360 | $SiO_2$ | 20 | $2\times10^{20}$ |
| Comparative Example 1 | None | | $SiO_2$ | 60 | $5\times10^{20}$ |

In the embodiments 2 to 4, it is revealed that sodium is effectively blocked. However, in the comparative example 1, because there is no lower layer available, sodium is hardly blocked.

Also, in the embodiments 3, 4, the film thickness of the upper layer is out of the suitable range and as a result, in contrast to the embodiment 1 and the embodiment 2, the effect of sodium block is reduced. Note that, from the view point of the life of the electron-emitting characteristics, the surface sodium concentration (in the vicinity of approximately 30 nm) is preferably equal to or less than $2\times10^{19}$ atom/cm$^3$.

Also, in the embodiment 3, the diffusion amount of silver which is the wiring material was raised approximately by the ones place in contrast to others.

(Embodiment 5, Comparative Example 2)

Similar to the embodiments 1 to 4, after the sodium block layer was formed, the electrode and the wiring were formed and the surface sodium concentration (in the vicinity of approximately 30 nm) of the sample treated with a heating step was measured.

What is different from the embodiments 1 to 4 is that, in the embodiment 5, the pulverizing condition of $SnO_2$ was changed so that the average particle size as expressed in the medial value becomes 18 nm, while in the case of the comparative example 2, it becomes 120 nm.

As a result, in the embodiment 5, it was revealed that the surface sodium concentration (in the vicinity of approximately 30 nm) becomes $4\times10^{18}$ atom/cm$^3$ and the sodium block effect is more effective.

On the other hand, in the comparative example 2, the flatness of the surface after the two layers were formed was poor and adherence to the substrate of the electrode and the wiring was poor and hence the preparation of the device did not proceed well.

Also, though the average particle size as expressed in the median value of the $SnO_2$ was attempted to be brought down equal to or less than 5 nm for reference, it took time and cost much and did not proceed well.

From the above, it is considered that the average particle size as expressed in the median value of the metallic oxide compound particles of the first layer is preferably within the range of 6 nm to 60 nm and still more preferably within the range of 15 nm to 30 nm.

(Embodiment 6)

A sample doped with 2% of antimony in place of P for the first layer (lower layer) was prepared similar to the embodiment 1 and the surface sodium concentration (in the vicinity of approximately 30 nm) was measured.

As a result, the surface sodium concentration (in the vicinity of approximately 30 nm) became $1\times10^{20}$ atom/cm$^3$ and, in contrast to the embodiment 1, the sodium block effect was reduced.

(Embodiment 7)

Figure 15:
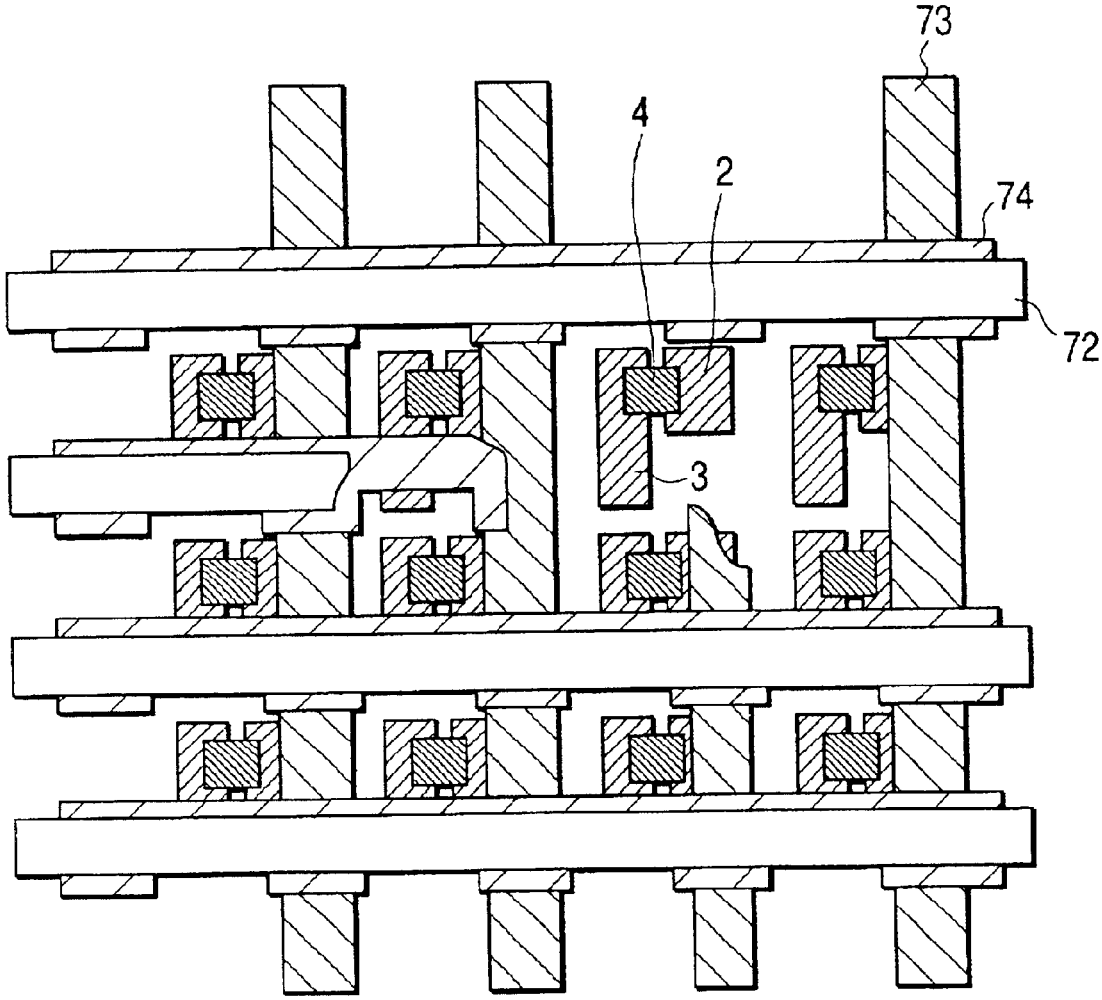
FIG. 15 is a schematic view showing the configuration of the electron source in a seventh embodiment.

In the present embodiment, by using the substrate formed in the embodiment 1, the surface conduction electron-emitting device was formed on it in plurality as shown in FIG. 15 and the electron source was prepared. By using this electron source, the image forming apparatus was manufactured as shown in FIG. 8.

Hereinafter, the manufacturing process of the electron source in the present embodiment will be described by using FIGS. 16A to 16E.

Figure 16A:
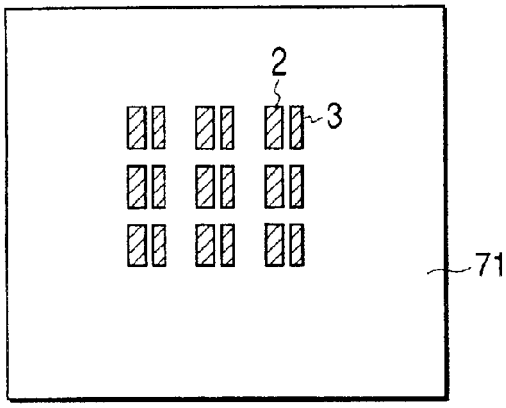
FIGS. 16A, 16B, 16C, 16D and 16E are schematic views for explaining the manufacturing step of the electron source in the seventh embodiment.

First, as shown in FIG. 16A, on the substrate 71 formed in the embodiment 1, a pair of electrodes 2, 3 were arranged in pairs in plurality.

Figure 16B:
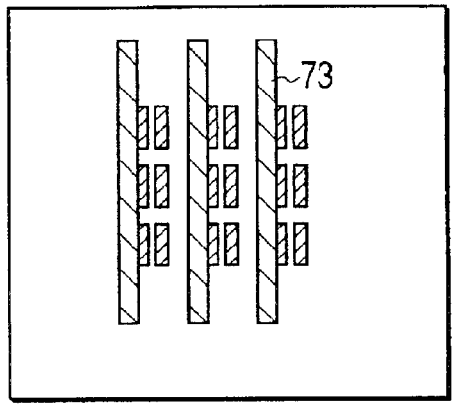

Next, the conductive silver paste used in the previous embodiment was prepared in such a manner as to cover a part of the electrode 2 by the above described screen printing method. After that, baking was performed and a Y directional wiring 73 with a width in 100 μm and a thickness in 12 μm was prepared (FIG. 16B).

Figure 16C:
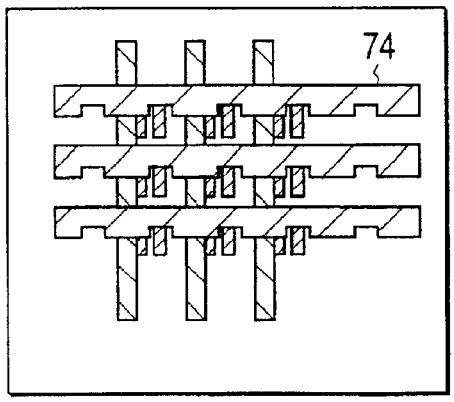

Next, the interlayer insulating layer 74 was applied in the direction orthogonal to the Y directional wiring 73 by the screen printing method and was formed by baking. The insulation paste (ink) material used here was a paste which comprises lead oxide as the principal component and combines glass binder and resin. This printing and baking were repeated four times and a comb teeth-like interlayer insulating layer 74 was prepared (FIG. 16C).

Figure 16D:
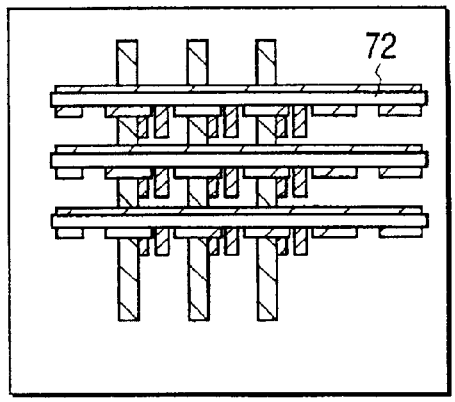
Figure 16E:
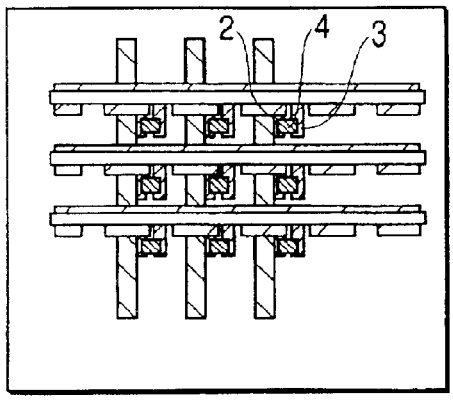

Next, on the interlayer insulating layer 74, the electron-conductive silver paste (ink) used in the previous embodiment was formed in such a manner as to cover a part of the electrode 3 by the screen printing method. After that, baking was performed and an X directional wiring 72 with a width in 100 $\mu$m and a thickness in 12 $\mu$m was prepared (FIG. 16D).

By the above, the matrix wiring where the stripe-like Y directional wiring 73 (lower wiring) and the stripe-like X directional wiring 72 (upper wiring) are orthogonal via the interlayer insulating layer 74 is formed.

Next, between the above described each pair of the device electrodes 2,3, the conductive film 4 was formed, which was performed by giving organic palladium contained solution in such a manner as to become 100 $\mu$m in a thickness by an ink jet injection equipment of the bubble jet method. After that, a heating processing was performed at 300° C. for 30 minutes, thereby obtaining the conductive film 4 comprising palladium oxide grains.

Forming and activation of the electron source 71 prepared as above were performed, panelized and driven.

To be concrete, the electron source 71 was fixed on the rear plate 81 and, upward of this rear plate, the faceplate 86 having phosphor of three primary colors (R, G, B) was positioned, and the outer frame 82 having a height of 2 mm where the frit glass was disposed in advance in the connecting portion was arranged between the faceplate and the rear plate. After that, by heating and pressurizing in the vacuum chamber, and by connecting (seal bonding) each member, the envelope (air-tight container) 88 was formed (FIG. 8).

When this airtight container (image forming apparatus) was driven by connecting to the drive circuit, it was possible to display exceptionally good images for a long period of time. Note that when a sodium concentration in the vicinity of the surface is approximately equal to or less than $2\times10^{19}$ atom/cm$^3$, similarly exceptionally good images can be displayed for a long period of time.

EFFECT OF THE INVENTION

As described above, according to the present invention, the following effect can be obtained.

The present invention can prevent the diffusion of Na from the substrate effectively and at low cost and provide the electron source forming substrate where elapsed time changes of the electron-emitting characteristics of the electron-emitting device caused by the diffusion of Na are reduced, the electron source and the image display apparatus.

What is claimed is:

1. An electron source comprising:

a substrate;

a first insulating material film disposed on said substrate:

a second insulating material film laminated on said first insulating material film; and a film containing an electron-emitting portion laminated on said second insulating material film, wherein said first insulating material film comprises a plurality of metallic oxide particles having an average particle size within a range of 6 nm to 60 nm as expressed in a median value.

2. The electron source according to claim 1, wherein said first insulating material film further comprises phosphorus.

3. The electron source according to claim 1, wherein said first insulating material film comprises phosphorus in 1 weight portion to 10 weight portions.

4. The electron source according to claim 1, wherein a thickness of said first insulating material film is within a range of 200 nm to 600 nm.

5. The electron source according to claim 1, wherein a thickness of said first insulating material film is within a range of 300 nm to 400 nm.

6. The electron source according to claim 1, wherein a thickness of said second insulating material is within a range of 20 nm to 150 nm.

7. The electron source according to claim 1, wherein a thickness of said second insulating material is within a range of 40 nm to 100 nm.

8. The electron source according to claim 1, wherein said first insulating material film comprises $SiO_2$.

9. The electron source according to claim 1, wherein said second insulating material film comprises $SiO_2$.

10. The electron source according to claim 1, wherein the average particle size as expressed in the median value is within a range of 15 nm to 30 nm.

11. The electron source according to claim 1, wherein the metallic oxide particles are electron conduction oxide particles.

12. The electron source according to claim 1, wherein the metallic oxide particles are metallic oxide particles chosen from at least one of the oxides of Fe, Ni, Cu, Pd, Ir, In, Sn, Sb and Re.

13. The electron source according to claim 1, wherein the metallic oxide particles are particles of $SnO_2$.

14. The electron source according to claim 1, wherein said substrate is a substrate comprising sodium.

15. The electron source according to claim 1, wherein said film containing an electron-emitting portion constitutes at least one electron-emitting device.

16. The electron source according to claim 15, wherein the at least one electron-emitting device is a plurality of electron-emitting devices that are matrix-wired by a plurality of row-directional wirings and a plurality of column directional wirings.

17. The electron source according to claim 15, wherein the at least one electron-emitting device is an electron-emitting device comprising a conductive film comprising an electron-emitting portion between one pair of electrodes.

18. The electron source according to claim 17, wherein the at least one electron-emitting device is a plurality of electron-emitting devices that are matrix-wired by a plurality of row-directional wirings and a plurality of column directional wirings, wherein the one pair of electrodes are composed of a material comprising platinum as a principal component, and wherein the wirings are composed of a material comprising silver as a principal component.

19. An image display apparatus comprising:

an envelope, at least one electron-emitting device disposed in said envelope on said substrate; and an image display member, for displaying images by irradiation of at least one electron from at least one electron-emitting device, wherein said substrate is said substrate according to claim 1.

20. The image display apparatus according to claim 19, wherein the at least one electron-emitting device is an electron-emitting device comprising a conductive film comprising an electron-emitting portion.

21. The image display apparatus according to claim 19, wherein the at least one electron-emitting device is a plurality of electron-emitting devices that are matrix-wired by a plurality of row-directional wirings and a plurality of column directional wirings.

22. The image display apparatus according to claim 19, wherein each of the electron-emitting devices is an electron-emitting device comprising a conductive film comprising an electron-emitting portion between one pair of electrodes.

23. The image display apparatus according to claim 22, wherein the at least one electron-emitting device is a plurality of electron-emitting devices that are matrix-wired by a plurality of row-directional wirings and a plurality of column directional wirings, wherein the one pair of electrodes are composed of a material comprising platinum as a principal component, and wherein the wirings are composed of a material comprising silver as a principal component.

* * * * *